US012736259B2

(12) United States Patent
Yu

(10) Patent No.: US 12,736,259 B2
(45) Date of Patent: Sep. 15, 2026

(54) HEAT PUMP SYSTEM

(71) Applicant: THE UNIVERSITY COURT OF THE UNIVERSITY OF GLASGOW, Glasgow (GB)

(72) Inventor: Zhibin Yu, Glasgow (GB)

(73) Assignee: THE UNIVERSITY COURT OF THE UNIVERSITY OF GLASGOW, Glasgow (GB)

( * ) Notice: Subject to any disclaimer, the term of this patent is extended or adjusted under 35 U.S.C. 154(b) by 238 days.

(21) Appl. No.: 18/028,723

(22) PCT Filed: Sep. 29, 2021

(86) PCT No.: PCT/EP2021/076855
§ 371 (c)(1),
(2) Date: Mar. 27, 2023

(87) PCT Pub. No.: WO2022/069581
PCT Pub. Date: Apr. 7, 2022

(65) Prior Publication Data

US 2023/0366599 A1 Nov. 16, 2023

(30) Foreign Application Priority Data

Sep. 30, 2020 (GB) ..... 2015531

(51) Int. Cl.
*F25B 47/02* (2006.01)

(52) U.S. Cl.
CPC ..... *F25B 47/025* (2013.01)

(58) Field of Classification Search
CPC .. F25B 47/025; F25B 47/022; F25B 2347/02; F25B 2347/021; Y02E 60/14
See application file for complete search history.

(56) References Cited

U.S. PATENT DOCUMENTS 5,269,151 A * 12/1993 Dinh ..... F25B 47/022 62/81
2015/0176866 A1* 6/2015 Takayama ..... F25B 49/02 62/140

(Continued)

FOREIGN PATENT DOCUMENTS

EP 0449641 A2 10/1991
EP 0485203 A1 5/1992

(Continued)

OTHER PUBLICATIONS

International Search Report and Written Opinion, International Application No. PCT/EP2021/076855, EPO—International Searching Authority, dated Feb. 24, 2022, 21 pages.

(Continued)

*Primary Examiner* — Miguel A Diaz
(74) *Attorney, Agent, or Firm* — Quarles & Brady LLP

(57) ABSTRACT

A heat pump system for controlling the internal temperature of a building. The system comprises a compressor, a first heat exchanger, an expansion device and a second heat exchanger which are fluidly coupled together by a flow of refrigerant to define a refrigerant circuit, and a thermal energy storage means which is thermally couplable to the refrigerant circuit to exchange thermal energy with the refrigerant. The heat pump system is configured to be operable in a normal heating mode and in a defrosting mode. In the normal heating mode, thermal energy is transferred from the second heat exchanger into the refrigerant and transferred from the refrigerant by the first heat exchanger to heat the building. In the defrosting mode thermal energy is transferred from the thermal energy storage means into the refrigerant and transferred from the refrigerant by the first heat exchanger to heat the building and by the second heat exchanger to defrost the second heat exchanger. The heat pump system comprises a switching assembly which is (Continued)

configured to switch between the normal heating and defrosting modes, and wherein the switching assembly is configured, when operating the heat pump system in the defrosting mode, to direct refrigerant exiting the first heat exchanger to flow through the second heat exchanger to cause residual heat in the refrigerant to defrost the second heat exchanger.

22 Claims, 11 Drawing Sheets

(56) References Cited

U.S. PATENT DOCUMENTS

| | | | | |
|---|---|---|---|---|
| 2017/0248349 | A1* | 8/2017 | Kujak | F25B 9/008 |
| 2019/0032979 | A1 | 1/2019 | Kasamatsu et al. | |

FOREIGN PATENT DOCUMENTS

| | | | |
|---|---|---|---|
| JP | S63247572 | A | 10/1988 |
| JP | H01189447 | A | 1/1989 |
| JP | H01305277 | A | 12/1989 |
| JP | H02251051 | A | 10/1990 |
| JP | H03282149 | A | 12/1991 |
| JP | H0526542 | A | 2/1993 |
| JP | 2001056159 | A | 2/2001 |
| JP | 2006170536 | A | 6/2006 |
| JP | 2008082589 | A | 4/2008 |
| JP | 2015210027 | A | 11/2015 |
| JP | 2017198407 | A | 11/2017 |

OTHER PUBLICATIONS

China National Intellectual Property Administration; Notification of the First Office Action of Application No. or Patent No. 202180080404.4, Jul. 3, 2025; 16 pages.

European Patent Office, Examination report of Application No. 21 786 190.5-1015, Apr. 16, 2025; 4 Pages.

UK Intellectual Property Office, Search Report of Application No. GB201553I.3, Mar. 9, 2021; 4 pages.

Japan Patent Office, Office Action of Japanese Patent Application No. 2023 / 519990, Jul. 9, 2025; 41 pages.

* cited by examiner

HEAT PUMP SYSTEM

RELATED APPLICATIONS

This application is a 35 U.S.C. § 371 national phase application of PCT/EP2021/076855 (WO-2022/069581-A1), filed on Sep. 29, 2021, entitled "A HEAT PUMP SYSTEM", and claims priority to GB-2015531.3 filed on Sep. 30, 2020, which is incorporated herein by reference in its entirety.

FIELD OF THE INVENTION

The present invention relates to a heat pump system and method of operating the heat pump system.

BACKGROUND OF THE INVENTION

It is known to provide a heat pump to extract thermal energy (i.e. heat) from a heat source, such as ambient external air, and then release the extracted thermal energy into an enclosed space, such as the interior of a building. Any heat source which has a temperature above absolute zero contains some thermal energy, which can be harnessed to increase the internal temperature of the enclosed space.

An example of a known heat pump system is an air-source heat pump (ASHP), which typically includes an evaporator, a compressor, a condenser, and an expansion device. The components of the ASHP are fluidly connected by a fluid conduit to form a refrigerant circuit. The evaporator and condenser each comprise heat exchangers which are configured to allow heat to be transferred into, and/or out of, a refrigerant which flows through the refrigerant circuit. The evaporator is arranged in an external location such that it can transfer heat from the ambient external air, whereas the condenser is typically coupled to a central heating system of the building.

The refrigeration circuit starts at the compressor with vaporised refrigerant being compressed to form a hot vapour. The hot refrigerant vapour is then directed towards the condenser which transfers some of the heat from the refrigerant, and thereby condenses the vapour into a liquid. The flow of liquid refrigerant then proceeds to the expansion valve where it expands, thereby reducing pressure and temperature. The cold refrigerant mixture is directed through the evaporator whereupon it transfers heat from the external air causing the refrigerant to vaporise. The refrigerant vapour is then directed back round to the compressor to start the refrigerant circuit, once again.

A known problem of ASHPs is that the heating capacity and coefficient of performance (COP) drops dramatically as the ambient external air temperature falls. This means that when an influx of heat is most needed to increase the internal temperature of the building, the performance of the ASHP drops to its lowest level.

A further problem with known ASHPs is that when the outside temperature drops below approximately 6° C., frost and ice may form on the coils, or fins, of the evaporator. The build-up of ice reduces the operating efficiency of the evaporator, which can cause the ASHP to stop working. It is necessary to defrost the evaporator regularly to prevent this build-up of ice, especially in cold and humid climates.

A typical method of defrosting the evaporator involves reversing the flow direction of the refrigerant through the circuit, causing refrigerant from the compressor to be directed towards the evaporator. This so-called 'reverse cycling method' works by configuring the ASHP to extract heat from the condenser to melt the ice that has accumulated in the evaporator.

An alternative approach is to provide the refrigerant circuit with a bypass conduit, or channel, which is arranged to fluidly connect the output of the compressor to the input of the evaporator whilst bypassing the condenser. This 'hot-gas bypass method' configures the compressor to produce hot vaporised refrigerant which is then directed toward the evaporator to melt the ice which has formed thereon.

Another alternative defrosting method uses a separate electrical heater which is configured to directly heat the external surface of the evaporator to melt the frost and ice that builds up during cold and humid conditions. This defrosting method uses additional electrical power and it also requires that the ASHP unit is switched off during the defrosting process, which results in an interruption of the heat supply to the interior of the building.

Each of these defrosting methods consumes electrical power without providing heat to the interior of the building during defrosting operation. For example, during the hot-gas bypass method, the compressor is operated to provide hot refrigerant vapour but none of the heat that is supplied to the building's central heating system, because the hot vapour is diverted away from the condenser. Alternatively, the reverse cycling method causes cool refrigerant to flow through the condenser on its way to the evaporator. This causes heat to be extracted from the condenser, which can lead to a reduction in the temperature of the building's interior.

During the operation of each of these defrosting methods, it is necessary to provide a backup source of heat, such as an electric heater or a gas boiler, in order to provide heating for the interior of the building whilst the evaporator is being defrosted. Accordingly, each of the defrosting methods significantly reduces the overall coefficient of performance (COP) of the heat pump system.

The present disclosure aims to address one or more of the above problems with existing heat pump systems.

SUMMARY OF THE INVENTION

At their broadest, aspects of the present invention provide a heat pump system which is configured, when operating in a defrosting mode, to direct residual thermal energy from a condenser to defrost an evaporator whilst also directing stored thermal energy from a thermal energy storage means to the condenser in order to heat the interior of a building during the defrosting operation. Aspects of the invention also provide a method of operating a heat pump system in a defrosting mode which comprises directing residual thermal energy from a condenser to defrost an evaporator and directing stored thermal energy from a thermal energy storage means to a condenser.

A first aspect of the present invention provides a heat pump system for a building temperature control system, the system comprising a compressor, a first heat exchanger, an expansion device and a second heat exchanger which are fluidly coupled together by a flow of refrigerant to define a refrigerant circuit, and a thermal energy storage means which is thermally couplable to the refrigerant circuit to exchange thermal energy with the refrigerant. The heat pump system is configured to be operable in a normal heating mode and in a defrosting mode. In the normal heating mode, thermal energy is transferred from the second heat exchanger into the refrigerant and transferred from the refrigerant by the first heat exchanger to heat the building, and in the defrosting mode thermal energy is transferred from the thermal energy storage means into the refrigerant and transferred from the refrigerant by the first heat exchanger to heat the building and by the second heat exchanger to defrost the second heat exchanger. The heat pump system comprises a switching assembly which is configured to switch between the normal heating and defrosting modes, and wherein the switching assembly is configured, when operating the heat pump system in the defrosting mode, to direct refrigerant exiting the first heat exchanger to flow through the second heat exchanger to cause residual heat in the refrigerant to defrost the second heat exchanger.

The refrigerant circuit is configurable, by the switching assembly, such that residual thermal energy in the refrigerant exiting from the first heat exchanger is directed towards the second heat exchanger in order to melt the ice which has built up on its outer surfaces.

The residual heat from the first heat exchanger represents the excess heat which has not been transferred into a central heating system of the building by the first heat exchanger. This 'residual heat' is typically wasted in known heat pump systems. During the defrosting operation, the thermal energy storage means is configured to transfer stored thermal energy into the refrigerant circuit, which enables the first heat exchanger to continue to provide heat to the building's central heating system.

Accordingly, the defrosting mode of the heat pump system is capable of combining second heat exchanger defrosting with continuous (i.e. uninterrupted) heating of the building. This functionality eliminates the need for backup heaters, which significantly improves the coefficient of performance (COP) of the heat pump system and thereby reduces its operating costs.

Optional features will now be set out. These are applicable singly or in any combination with any aspect.

It will be appreciated that the term 'refrigerant' is used herein to refer to a heat transfer fluid, e.g., a fluid that is capable of transitioning between a gas and liquid phase, and that can be used in a heat transfer process. For example, the refrigerant may comprise any heat transfer fluid capable of serving as an intermediary in cooling on one side of a heat transfer process, heating on another side of the heat transfer process, and transferring thermal energy from one side of the process to the other side. Accordingly, each of the refrigerant circuits described herein may define a heat transfer fluid circuit, according to the present disclosure.

The first and second heat exchangers may define internal and external heat exchangers, respectively. That is, the first heat exchanger may be arranged to transfer thermal energy between the heat pump system and an interior space of a building, whereas the second heat exchanger may be arranged to transfer thermal energy between the heat pump system and an external environment. Accordingly, the first and second heat exchangers may be defined, respectively, as indoor, and outdoor heat exchangers (or units) of the heat pump system. The first heat exchanger may be a condenser. The second heat exchanger may be an evaporator.

It will be appreciated that the expansion device may comprise any expansion apparatus which is suitably configured to cause expansion of the refrigerant. For example, the expansion device may comprise an expansion valve. The expansion device may be configured to operate in either flow direction. As such, the expansion device may be a capillary tube. Alternatively, the expansion device may comprise two or more one-way expansion valves arranged in a switchable circuit so as to cause expansion of the refrigerant flow in either direction, as would be understood by the skilled person. An alternative expansion device may comprise an arrangement of two asymmetric expansive devices connected together with two one-way valves. Alternatively, the expansion device may comprise a single asymmetric expansive valve which is coupled to the refrigerant circuit by four control valves, as would be understood by the skilled person.

The switching assembly may be configured, when operating the heat pump system in the defrosting mode, to direct refrigerant exiting the first heat exchanger through, sequentially, the second heat exchanger, the expansion device, and the compressor. In this way, the heat pump system may be configured to cause residual thermal energy from the first heat exchanger to be carried by the refrigerant to defrost the evaporator. Accordingly, the switching assembly may be arranged downstream from the first heat exchanger and upstream from the compressor.

The switching assembly may be configured to direct refrigerant from the first heat exchanger through, sequentially, the thermal energy storage means, the expansion device, the second heat exchanger and the compressor. In this way, the thermal energy storage may be configured such that, during the normal heating mode, at least some of the residual thermal energy which is present in the warm refrigerant exiting from the condenser is transferred into the thermal energy storage device. Accordingly, during the normal heating mode, the thermal energy storage may be configured to recover residual thermal energy from the warm refrigerant exiting from the condenser.

The thermal energy storage means may be coupled to the refrigerant circuit between the expansion device and the compressor, in order to recover and store the residual thermal energy carried by the refrigerant.

The switching assembly may comprise a four-way valve which, when operating the heat pump system in the defrosting mode, may be configured to directly couple the first heat exchanger to the second heat exchanger. The four-way valve provides a convenient means of redirecting the flow of refrigerant through the heat pump system.

Alternatively, it will be appreciated that the switching assembly may comprise any suitably configured 'four-way' switching means (e.g. an assembly of four interconnected one-way valves, or an assembly of two interconnected two-way valves).

The switching assembly may be arranged, when operating the heat pump system in the defrosting mode, to bypass the expansion device (i.e. a first expansion device) and direct refrigerant exiting the first heat exchanger through, sequentially, a second expansion device, the second heat exchanger and the compressor. This enables the heat from the thermal energy storage means to be transferred by the refrigerant to defrost second heat exchanger.

The switching assembly may comprise a first bypass assembly which may be configured, when the heat pump system may be operating in the defrosting mode, to isolate the expansion device (i.e. the first expansion device) from the refrigerant circuit. This arrangement allows the warm refrigerant from the thermal energy storage means to reach the second heat exchanger to melt the ice that has built up thereon.

In embodiments, the thermal energy storage means may be coupled to the refrigerant circuit between the second expansion device and the second heat exchanger.

The switching assembly may comprise a second bypass assembly which, when the heat pump system may be operating in the defrosting mode, may be configured to fluidly couple the second expansion device to the refrigerant circuit between the first heat exchanger and the thermal energy storage means. The second expansion device is thereby configured to lower the pressure of the refrigerant, such that it can more efficiently absorb the heat stored in the thermal energy storage means as it passes therethrough.

The heat pump system may be operable in a heat charging mode in which thermal energy may be transferred from the refrigerant to the thermal energy storage means, wherein the switching assembly, when operating the heat pump system in the heat charging mode, may be configured to direct refrigerant exiting the compressor to bypass the second expansion device and the first heat exchanger. In this mode, thermal energy from the compressor is directed to be stored in the thermal energy storage means when heat is not required by the occupants of the building.

The heat pump system may be operable in an auxiliary heating mode in which thermal energy may be transferred from the thermal energy storage means into the refrigerant, wherein the switching assembly, when operating the heat pump system in the auxiliary heating mode may be configured to bypass the expansion device and the second heat exchanger. Accordingly, thermal energy stored in the thermal energy storage means may be used to provide heat to the interior of the building when defrosting of the second heat exchanger (e.g. evaporator) is not required.

The thermal energy storage means may comprise a phase change material. The phase change material may be arranged in direct thermal contact with a conduit of the refrigerant circuit. The phase change material may be configured to provide (and store) thermal energy at a substantially constant temperature which improves the control the heat pump system. The phase change material may also be configured to store a large amount of thermal energy in a relatively small volume which increases the packaging efficiency of the heat pump system.

The thermal energy storage means may be thermally coupled to a conduit of the refrigerant circuit by a separate fluid circuit comprising heat transfer fluid (e.g. water). The separate fluid circuit enables the thermal energy storage means to have a large capacity which can be arranged externally to the rest of the heat pump system.

The heat pump system may further comprise a refrigerant storage means which may be fluidly coupled to an output of the first heat exchanger. The refrigerant storage means may be configured to accommodate fluctuations in the volume of refrigerant flowing through the refrigerant circuit during the operation of the heat pump system.

The heat pump system may further comprise a phase separator which may be fluidly connected to an input port of the compressor, to prevent unwanted fluid from entering the compressor.

The refrigerant circuit may comprise a high-pressure stage and a low-pressure stage which are fluidly coupled together by a phase separator. The high-pressure stage may comprise (i.e. be fluidly coupled to) the first heat-exchanger and the low-pressure stage may comprise (i.e. be fluidly coupled to) the second heat-exchanger. Accordingly, the heat pump system comprising the high-pressure and low-pressure stages may define a double-stage heat pump system.

At least one, or each, of the high-pressure and low-pressure stages may be fluidly coupled to the phase separator. The high-pressure stage may be fluidly coupled to a gas containing portion, or section, of the phase separator. For example, the high-pressure stage may be configured to receive gaseous refrigerant from the gas containing portion of the phase separator. The low-pressure stage may be fluidly coupled to a liquid containing portion of the phase separator. For example, the low-pressure stage may be configured to receive liquid refrigerant from the liquid containing portion of the phase separator. The high-pressure stage may be configured to deliver a mixture of liquid-gas refrigerant to the phase separator. Accordingly, the high-pressure stage circuit may be configured to deliver the liquid-gas refrigerant mixture to the liquid containing portion of the phase separator.

The refrigerant circuit may define a refrigerant circuit assembly comprising the high-pressure and low-pressure stages. The high-pressure and low-pressure stages may be fluidly coupled to each other, in that they may share the same refrigerant which is circulated around both stages. The refrigerant in the high-pressure stage may be, on average, held at a higher-pressure than at the equivalent section of the low-pressure stage. The low-pressure stage may be configured to uplift the temperature of the refrigerant from a low temperature (e.g. at the evaporator) to an intermediate temperature (e.g. in the phase separator). The high-pressure stage may be configured to uplift the temperature of the refrigerant from an intermediate temperature (e.g. in the phase separator) to a high temperature (e.g. in the condenser). The The heat pump system may be operable during the normal heating mode (e.g., by configuring the switching assembly accordingly) such that thermal energy is transferred from the refrigerant to the thermal energy storage means. For example, this may involve directing the flow of refrigerant from the first heat exchanger (e.g., condenser) to a location in the refrigerant cycle which is thermally couplable to the thermal energy storage means to transfer at least some of the heat in the refrigerant to the phase change material whereupon it can be stored for later use. In this way, the heat pump system may be configured to provide heat to the interior of a building (i.e., via the condenser) whilst simultaneously charging the thermal energy storage device. This mode of operation may define a continuous heating and charging mode.

The thermal energy storage means may be thermally couplable to the phase separator. The thermal energy storage means may be thermally couplable to a liquid containing portion, or phase, of the phase separator. The phase change material may be thermally coupled to phase separator of the refrigerant circuit by a separate circuit comprising a heat transfer fluid, or refrigerant. The phase change material may be arranged within the phase separator. The separate refrigerant circuit may comprise a switching assembly and/or a pump configured to control the flow of refrigerant, and therefore thermal energy, between the phase separator and the thermal energy storage device. The phase change material may be encapsulated in a case formed of a thermally conductive material, to enable thermal conduction between the phase change material and the refrigerant in the phase separator.

The compressor may define a compressor assembly comprising a first compressor fluidly coupled to the high-pressure stage. The compressor assembly may comprise a second compressor fluidly coupled to the lower-pressure stage.

The compressor may comprise a vapour injection compressor which is fluidly coupled to both the high-pressure and low-pressure stages of the refrigerant circuit. The low-pressure stage may be fluidly coupled to low pressure intake of the compressor, whilst a high-pressure output of the compressor may be fluidly coupled to the high-pressure stage. An intermediate intake may be fluidly coupled to the phase separator.

The expansion device may define an expansion device assembly comprising a first expansion device fluidly coupled to the high-pressure stage. The expansion device assembly may comprise a second expansion device fluidly coupled to the lower-pressure stage.

The switching assembly may be arranged, when operating the heat pump system in the defrosting mode, to bypass the first expansion device and direct refrigerant exiting the first heat exchanger through, sequentially, a second expansion device, the second heat exchanger and the phase separator.

A second aspect of the present disclosure provides a building comprising the heat pump system according to any one the preceding paragraphs. The second heat exchanger is thermally coupled to an external heat source, and the first heat exchanger is thermally coupled to a central heating system of the building.

A third aspect of the present disclosure provides a method of operating a heat pump system according to any one of the preceding paragraphs. The method is directed towards operating the heat pump system for controlling the internal temperature of a building. The method comprises, when operating the heat pump system in the defrosting mode, directing refrigerant exiting the first heat exchanger to flow through the second heat exchanger to cause residual heat in the refrigerant to defrost the second heat exchanger.

The method may comprise switching the heat pump system between the normal heating mode and at least one of an auxiliary heating mode and a defrost mode according to the present invention.

In embodiments, the method may comprise switching the heat pump system between the normal heating mode and a defrosting mode when there is no ice on the evaporator. The method may comprise switching the heat pump system between the normal heating mode and an auxiliary heating mode. The method may comprise switching periodically between the different operating modes, in order to increase the COP of the heat pump system.

According to each of the above described switching strategies, the heat pump system may be configured to work as a quasi-two stage heat pump system, by using only a single refrigerant circuit (i.e. the apparatus of a single stage heat pump). In this way, the heat pump system according to the present invention is able to deliver a continuous supply of heat to the interior of a building without requiring the complexity and cost of a two-stage heat pump system.

In embodiments, the method may comprise operating the heat pump system according to at least one of the normal heating mode and the heat charging mode, during periods of off-peak electricity (i.e. when the price of grid electricity is cheaper), in order store thermal energy in the thermal energy storage device for use later on. In this way, the COP of the heat pump system may be increased.

A fourth aspect of the present disclosure provides a method of operating a heat pump system for controlling the internal temperature of a refrigeration unit. The system comprises a compressor, a condenser, an expansion device and an evaporator which are fluidly coupled together by a flow of refrigerant to define a refrigerant circuit, and a thermal energy storage means which is thermally couplable to the refrigerant circuit to exchange thermal energy with the refrigerant, wherein the refrigerant circuit comprises a high-pressure stage and a low-pressure stage which are fluidly coupled together by a phase separator, wherein the high-pressure stage comprises the condenser and the low-pressure stage comprises the evaporator. The heat pump system is configured to be operable in a cool charging mode and in an auxiliary cooling mode wherein:

in the cool charging mode, thermal energy is transferred from the thermal energy storage means into the refrigerant and transferred from the refrigerant by the condenser to heat the external ambient air, and in the auxiliary cooling mode thermal energy is transferred from the evaporator into the refrigerant to cool the internal area of the refrigeration unit and transferred from the refrigerant to the thermal energy storage means;

wherein the method comprises, when operating the heat pump system in the cool charging mode, isolating the high-pressure stage and, when operating the heat pump system in the auxiliary cooling mode, isolating the low-pressure stage.

According to the fourth aspect of the disclosure, the method enables the double-stage heat pump system to be operated as a refrigerating system. In particular, the system may be configured to cool an area that requires cooling, such as the internal volume of a refrigerator unit, or a building. It will be appreciated that for refrigeration (i.e., cooling) applications, the heat pump system may be configured in a reverse arrangement compared to heating applications. For example, the condenser may be exposed to ambient air (e.g., outside a refrigerated area) and the evaporator may be positioned where the load is required (e.g., inside the refrigerated area). In this case, the required load may be a negative thermal load (i.e., cold) which is used to lower the temperature of the refrigerated area. Accordingly, when operating the heat pump system in the cool charging mode, the switching assembly may be configured to remove, or extract, thermal energy (i.e., heat) from the thermal energy storage means. This may be considered as 'charging' the thermal energy storage means with 'cold thermal energy'. The stored 'cold thermal energy' may be used, when operating the heat pump system in the auxiliary cooling mode, to reduce the temperature of the refrigerant passing to the evaporator (i.e., by extracting thermal energy from the refrigerant and storing it in the thermal energy storage means) and thereby cooling the refrigerated area.

The method may comprise operating the heat pump system according to the cool charging mode, during periods when the external ambient air temperature is low (e.g. such as in the evening), in order to store cool thermal energy in the thermal energy storage device for use later on. Then, when operating the heat pump system in the auxiliary cooling mode, the cool thermal energy stored in the thermal energy storage device can be directed to cool the interior volume of the refrigeration unit. In this way, the COP of the heat pump system may be increased.

A fifth aspect of the present disclosure provides a controller, or control system, for controlling a heat pump system according to any one of the preceding paragraphs. The controller may be configured to perform a method according to any one of the preceding paragraphs. In particular, the controller may be configured to control the switching means in order to operate the heat pump system in at least one of a plurality of operating modes.

Each of the exemplary heat pump systems may be incorporated within an air source heat pump system, i.e., configured to extract thermal energy from ambient air, as would be understood by the skilled person. Alternatively, each of the above heat pump systems may be configured for use in a water source heat pump system and/or a ground source heat pump system.

The skilled person will appreciate that except where mutually exclusive, a feature or parameter described in relation to any one of the above aspects may be applied to any other aspect. Furthermore, except where mutually exclusive, any feature or parameter described herein may be combined with any other feature or parameter described herein.

BRIEF DESCRIPTION OF THE DRAWINGS

Aspects and embodiments of the disclosure will now be described by way of example with reference to the accompanying drawings in which.

DETAILED DESCRIPTION

Figure 1:
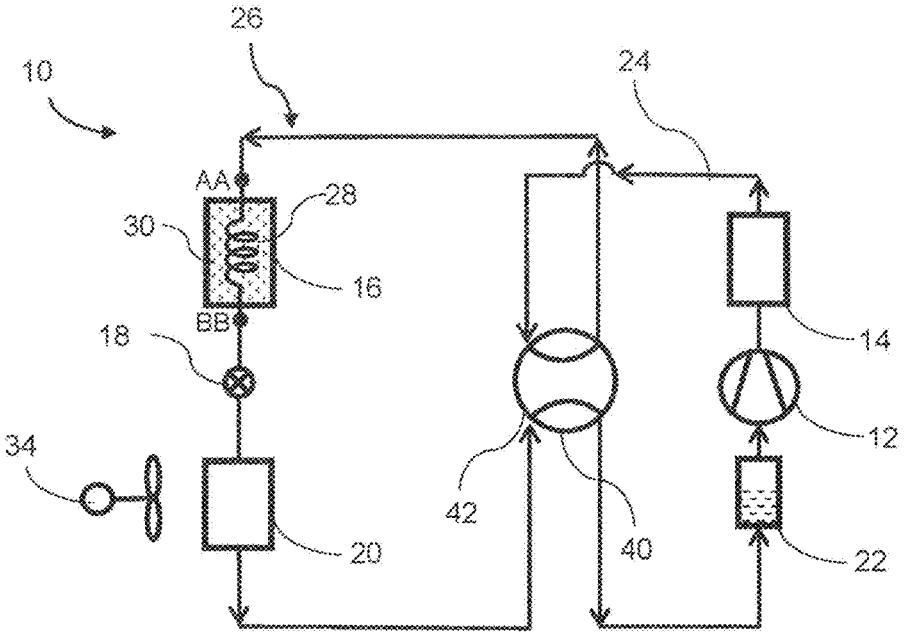
FIG. 1 is a schematic diagram of a single stage heat pump system according to a first arrangement of the present disclosure, the heat pump system is configured to operate in a normal heating mode.

Aspects and embodiments of the present disclosure will now be discussed with reference to the accompanying figures. Further aspects and embodiments will be apparent to those skilled in the art.

Simile-Stacie Heat-Pump System

A heat pump system 10 according to a first arrangement of the present disclosure will now be described with reference to FIGS. 1 to 4. The heat pump system 10 forms part of an air-source heat pump (ASHP) which is configured to transfer thermal energy (i.e. heat) from outside to inside a building (not shown).

The heat pump system 10 includes a compressor 12, a condenser 14, a thermal energy storage device 16, an expansion device 18, an evaporator 20 and an optional phase separator 22 which are fluidly connected by a fluid conduit 24 in order to define a refrigerant circuit 26. The fluid conduit 24 defines a fluid pathway through which the refrigerant is directed between the components of the heat pump system 10, as would be readily understood by the skilled person. Accordingly, the heat pump system 10 defines a single-stage heat pump system since it includes only a single refrigerant circuit 26.

The heat pump system 10 is configured to be operable in a normal heating mode in which thermal energy is transferred from an external heat source via the evaporator into the refrigerant and transferred from the refrigerant to an interior of the building by the condenser 14.

Figure 3:
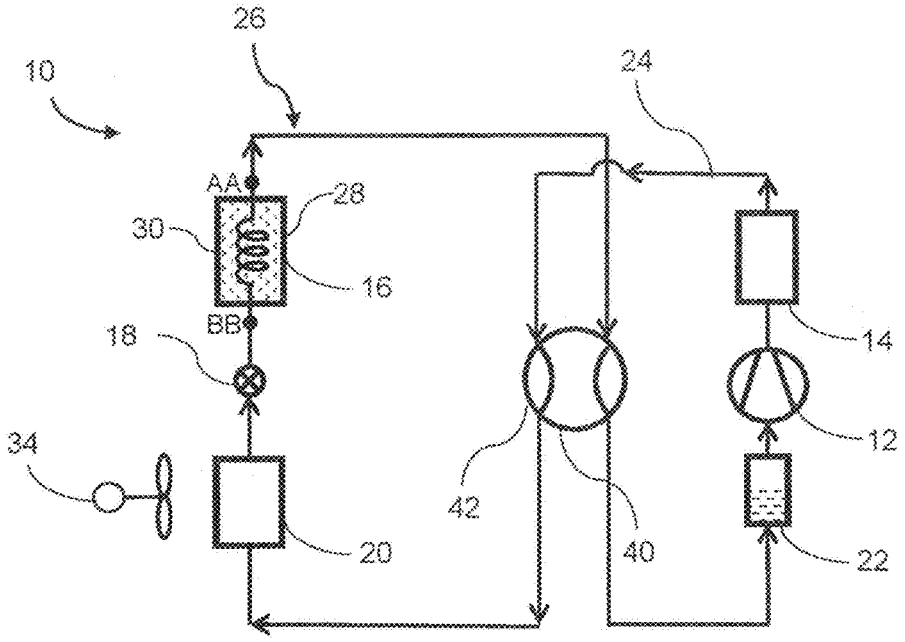
FIG. 3 is a schematic diagram of the heat pump of FIG. 1, configured to operate in a defrosting mode.

The heat pump system 10 also includes a switching assembly 40 which is configured to switch between the normal heating mode (as shown in FIG. 1) and a defrosting mode (as shown in FIG. 3). In the normal heating mode, thermal energy is transferred from the evaporator 20 into the refrigerant and then directed to the condenser 14 to heat the building, whilst residual thermal energy from the condenser is also directed to heat the thermal energy storage device 16.

In the defrosting mode, thermal energy is transferred from the thermal energy storage device 16 into the refrigerant and then directed to heat both the condenser 14 and evaporator 20. In this way, the stored heat in the thermal energy storage device 16 can be used as a heat source during the defrosting mode. The heat pump system 10 is, therefore, able to provide continuous heating during the defrosting of the evaporator 20, which eliminates the need for a backup heater.

The components of the heat pump system 10 will now be described with particular reference to FIGS. 1 and 3. The refrigerant is a heat transfer fluid capable of absorbing, retaining and discharging thermal energy such that it can be transferred between the different components of the refrigerant circuit 26. In embodiments, the refrigerant comprises 1,1,1,2-tetrafluoroethane (134a), which is a hydrofluorocarbon and haloalkane material with insignificant ozone depletion potential. It has the chemical formula $CF_3CH_2F$ and a boiling point of −26.3° C. at atmospheric pressure. In alternative embodiments, the refrigerant may be one of a number of suitably configured heat transfer fluids, as would be understood by the skilled person.

The refrigerant, in its gaseous state, is pressurised and circulated through the refrigerant circuit 26 by the compressor 12. The compressor 12 is an electrically powered mechanical device which is configured to increase the pressure of the refrigerant in the refrigerant circuit 26.

During use, the compressor 12 typically receives low pressure refrigerant through an inlet, the refrigerant is then pressurised by the compressor 12 and discharged through an outlet into the refrigerant circuit 26. By increasing the pressure of the refrigerant, the compressor 12 also increases the temperature of the refrigerant which is then circulated around the refrigerant circuit 26.

The evaporator 20 and the condenser 14 each comprise a heat exchanger which is arranged in direct thermal contact with the conduit 24 of the refrigerant circuit 26. Accordingly, each of the evaporator 20 and the condenser 14 are configured to enable thermal energy to be transferred into, and out of, the refrigerant which flows through the refrigerant circuit 26.

The condenser 14 defines a primary heat sink of the heat pump system 10. The condenser 14 is thermally coupled to the interior of the building. In particular, the condenser 14 is configured to transfer thermal energy between the refrigerant in the refrigerant circuit 26 and the ambient air inside the building. Accordingly, the condenser 14 defines an internal heat exchanger 14 of the heat pump system 10. The condenser 14 is thermally coupled to a central heating system of the building, and is configured to transfer thermal energy between the refrigerant in the refrigerant circuit 26 and a separate thermal transfer fluid (e.g. water) which flows through a central heating system of the building. Such a central heating system may be arranged to distribute thermal energy that it receives from the condenser 14 throughout different regions of the building. The circulated thermal energy is then discharged from a plurality of radiators, or an underfloor heating assembly, as would be readily understood by the skilled person.

The condenser 14 is configured to transfer thermal energy into the building at a heat production temperature (e.g., 65° C.). Put another way, the condenser 14 is arranged to receive pressurised vapour refrigerant at a higher temperature (e.g., approximately 91° C.).

In an alternative exemplary arrangement of the heat pump system 10, the central heating system of the building comprises an internal fan which is provided to direct a flow of air across a surface of the condenser 14 that is exposed to the interior of the building (e.g. coils, or fins). In this way, the internal fan is operable to increase the thermal energy exchange efficiency of the condenser 14.

The evaporator 20 defines a primary heat source of the heat pump system 10. When the heat pump system 10 is installed within a building, the evaporator 20 is arranged in an external location such that it can absorb heat from the ambient external air and transfer it into the refrigerant flowing through the refrigerant circuit 26. In this way, the evaporator 20 defines an external heat exchanger 20 of the heat pump system 10. An external fan 34 is provided to direct a flow of air across a surface which is exposed to external ambient air (e.g., coils, or fins) of the evaporator 20 in order to improve its thermal energy exchange efficiency. The evaporator 20 is configured to absorb thermal energy from the external environment when the ambient external air temperature is approximately 0° C.

The thermal energy storage device 16 comprises a thermal energy storage medium which is configured to retain thermal energy over a prolonged period of time. According to an exemplary arrangement of the heat pump system 10, the thermal energy storage medium comprises a phase change material which is housed within a housing 30, or enclosure, which is thermally insulated so as to retain any heat which is stored within the phase change material.

The phase change material is a substance which is configured to release and absorb sufficient energy at a phase transition of the material in order to provide useful heating and/or cooling of the refrigerant in the heat pump system 10. In alternative arrangements of the heat pump system 10, the thermal energy storage medium may comprise a heat transfer fluid, such as water, which may be held in a water tank, as would be readily understood by the skilled person. Alternatively, the thermal energy storage medium may comprise a plurality of heated stones, or pebbles, which are configured to transfer thermal energy directly into and out of the refrigerant circuit (e.g. through a conductive element) or via a separate heat transfer fluid circuit, as would be readily understood by the skilled person.

The phase change material is configured such that it undergoes a solid/liquid phase change at temperatures between 25-30° C. Accordingly, the phase change material is arranged to absorb and discharge heat into, and out of, the refrigerant at a temperature of between 25-30° C. As such, the phase change material is configured with a substantially constant heat storage and release temperature, which provides improved control of the recovery and release of the thermal energy into the refrigerant circuit 26.

It will be appreciated that the optimal operating temperature range for the thermal energy storage device 16 will depend, at least in part, on the operating temperatures of the heat source (e.g. the evaporator) and the heat sink (e.g. the condenser). In embodiments, the thermal energy storage device is configured to operate (e.g. transfer thermal energy into and out of the refrigerant circuit) at an intermediate temperature, which is below the operating temperature of the condenser and above the operating temperature of evaporator.

The phase change material is arranged in direct thermal contact with a conduit section 28 of the refrigerant circuit 26. The conduit section 28 is arranged to extend through an internal cavity of the housing 30 such that it is in direct thermal contact with the phase change material, as shown in FIG. 1. The conduit section 28 is configured with a coiled shape to increase its contact area with the phase change material. The conduit section 28 is at least partially formed of a thermally conductive material which is configured to allow conduction of the thermal energy between the refrigerant and the phase change material in the thermal energy storage device 16. As such, the thermal energy storage device 16 is configured to transfer (i.e. absorb and discharge) thermal energy into the refrigerant that flows through the conduit section 28.

Although, in the presently described embodiment the thermal energy storage device 16 is shown (in FIG. 1, for example) as having a coiled conduit section 28 running through the phase change material, it will be appreciated that this arrangement is just one of many possible configurations. For example, in an alternative exemplary arrangement the phase change material may be thermally coupled to the refrigerant in the refrigerant circuit by a finned heat exchanger. The heat pump system 10 may comprise other arrangements of the thermal energy storage device 16 without diverging from the scope of the present disclosure.

The thermal energy storage device 16 is configured to passively transfer thermal energy between the phase change material and the refrigerant in the refrigerant circuit 26. In particular, the thermal energy storage device 16 is configured such that when the temperature of the refrigerant is below the temperature of the phase change material, then the thermal energy which is stored in the phase change material is discharged into the refrigerant. Alternatively, if the refrigerant temperature is greater than the phase change material temperature, then the latent thermal energy within the refrigerant is discharged into, and absorbed by, the phase change material in the thermal energy storage device 16.

With particular reference to FIGS. 1 and 3, the thermal energy storage device 16 is located downstream from the condenser 14 such that it can recover heat from the warm liquid refrigerant exiting from the condenser 14, during the normal heating mode of operation. In this way, the thermal energy storage device 16 is configured to operate as a sub-cooler of the heat pump system 10. During the defrosting mode of the heat pump system 10, the recovered heat which is stored in the phase change material can be discharged back into the refrigerant during a subsequent operation. Hence, the thermal energy storage device 16 can also be configured to operate as a secondary, or auxiliary, heat source of the heat pump system 10.

The expansion device 18 is configured to reduce the pressure of the refrigerant in order to cause pressure and temperature drop, and subsequent evaporation of the refrigerant as its passes through the evaporator. As such, the expansion device 18 is configured to control the amount of refrigerant that is released into the evaporator 20. In this way, the expansion valve 18 is intended to regulate the superheating of vapour leaving the evaporator 20.

The expansion device 18 comprises an orifice through which the refrigerant is channelled. The orifice is configured to reduce the pressure of the refrigerant that flows through it, which also cools due to the associated drop in pressure. As such, the expansion device 18 is configured such that it does not extract thermal energy from the refrigerant. In this way, the expansion of the refrigerant flowing the expansion device occur due to a substantially isenthalpic process.

The expansion device 18 comprises a capillary tube which is configured to cause expansion of the refrigerant as it flows in either flow direction through the refrigerant circuit. According to an alternative arrangement, the expansion device 18 may comprise an assembly of two one-way expansion valves arranged in a bypass circuit, as would be readily understood by the skilled person.

The phase separator 22 is a two-phase gas-liquid separator which is configured to collect liquid refrigerant that is condensed in an upstream component of the refrigerant circuit 26. This may be caused by cooling or depressurisation of the refrigerant, for example. The phase separator 22 is arranged upstream of the compressor 12 and is thereby arranged to prevent liquid refrigerant from entering the compressor 12 where it may otherwise cause damage, and/or render its operation ineffective.

The switching assembly 40 comprises a four-way valve 42 which is configured to switch the operation of the heat pump system 10 between the normal heating and defrosting modes. This is achieved by adjusting the flow direction of refrigerant through the refrigerant circuit 26.

The operation modes of the heat pump system 10 will now be described in more detail. As described above, the normal heating mode is configured to heat the interior of the building and to simultaneously charge the thermal energy storage device 16 (i.e. to store thermal energy within the phase change material). The defrosting mode is configured to simultaneously heat the building and also defrost the evaporator 20.

When operating the heat pump system 10 in the normal heating mode, the four-way valve 42 is configured to directly couple the condenser 14 to the thermal energy storage device 16, as shown in FIG. 1. The four-way valve 42 is also configured to couple the evaporator 20 to the compressor 12. In particular, the flow of refrigerant exiting the condenser 14 is directed through the four-way valve 42, then on to the thermal energy storage device 16, through the expansion device 18, through the evaporator 20 before being directed back through the four-way valve 42 on its way to the compressor 12, via the phase separator 22.

The thermodynamic cycle of the normal heating mode commences with the compressor 12 extracting vapour from the separator 22, increasing its pressure and temperature. The superheated refrigerant vapour (e.g., at 91° C.) is directed to the condenser 14 where it transfers heat into the building at the heat production temperature (e.g., 65° C.). This causes the gaseous refrigerant to condense into a warm liquid at a higher temperature (e.g., 70° C.).

After exiting the condenser 14, the warm liquid refrigerant is directed to the thermal energy storage device 16 whereupon it transfers thermal energy to the phase change material which is housed therein. This causes the liquid refrigerant to cool down to subcooled temperature (e.g., approximately 35° C., which is a few degrees higher than the melting temperature of the phase change material (i.e. 30° C.).

Upon exiting the thermal energy storage device 16, the now subcooled liquid refrigerant then passes through the expansion device 18 before being directed to flow through the evaporator 20. As the refrigerant passes through the evaporator 20, it absorbs thermal energy from the external air (e.g., at 0° C.). The refrigerant then exits the evaporator 20 as a cold low-pressure vapour. Finally, the refrigerant flows to the liquid/vapour separator 22 to commence the next cycle of the refrigerant circuit 26. During the normal heating mode, each of the internal and external fans 34 are powered on to increase the efficiency of the heat transfer through the respective condenser 14 and evaporator 20.

Figure 2:
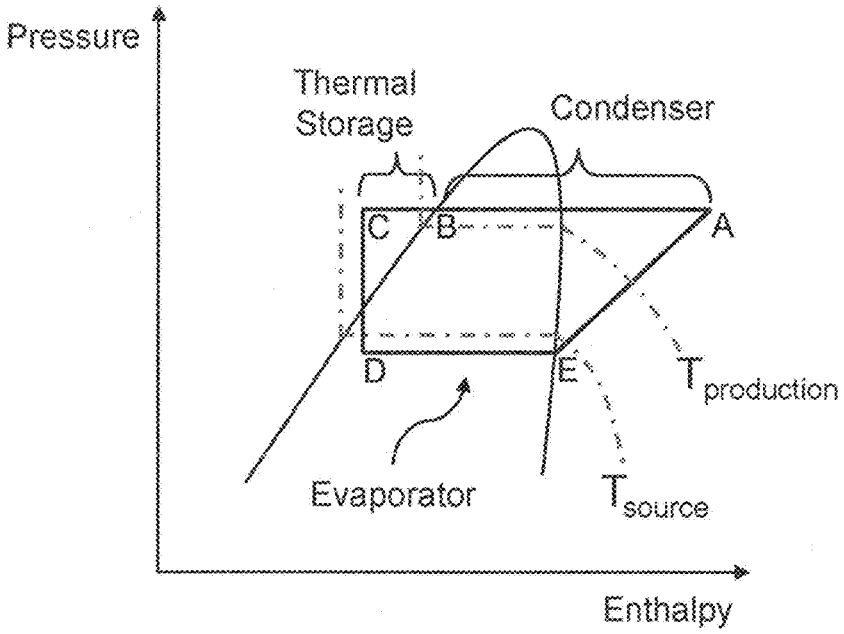
FIG. 2 is a graph showing the pressure-enthalpy curve corresponding to the normal heating mode of the heat pump system shown in FIG. 1.

The thermodynamic characteristics of the normal heating mode will now be described with reference to the pressure-enthalpy curve (p-h), as shown in FIG. 2. The presently described p-h curve is based on an outdoor air temperature of approximately 0° C., a heat production temperature (i.e. the operating temperature of the central heating system) of approximately 65° C., and a phase change material having a melting temperature of approximately 30° C.

The normal heating mode cycle commences with hot refrigerant vapour exiting from the compressor 12 (as indicated by point A on the p-h curve) and flowing towards the condenser 14 at a temperature of approximately 70° C. The refrigerant is condensed into a liquid by the condenser 14, and is then directed towards the thermal energy storage device 16 at a temperature of approximately 70° C. (B). The thermal energy storage device 16 recovers heat from the refrigerant and cools it down to a sub-cooled liquid at a temperature of approximately 35° C. (C). After the expansion of the refrigerant in the expansion device 18, it takes the form of a saturated mixture of gas and liquid at a temperature of approximately −10° C. (D). The refrigerant then enters the evaporator 20 where it absorbs heat from the outdoor air, which is at a temperature of approximately 0° C. The refrigerant then turns into saturated vapour at approximately −10° C. before then entering the separator 22 and subsequently the compressor 12 (E).

In known single refrigerant circuit heat pump systems, the 'residual' thermal energy from the condenser is wasted as the refrigerant is directed through, and 'throttled' by, the expansion device 18. The present disclosure makes use of the heat recovered from the refrigerant exiting the condenser 14 in order to defrost the evaporator 20, and so no additional electrically powered heater is required for defrosting.

Figure 4:
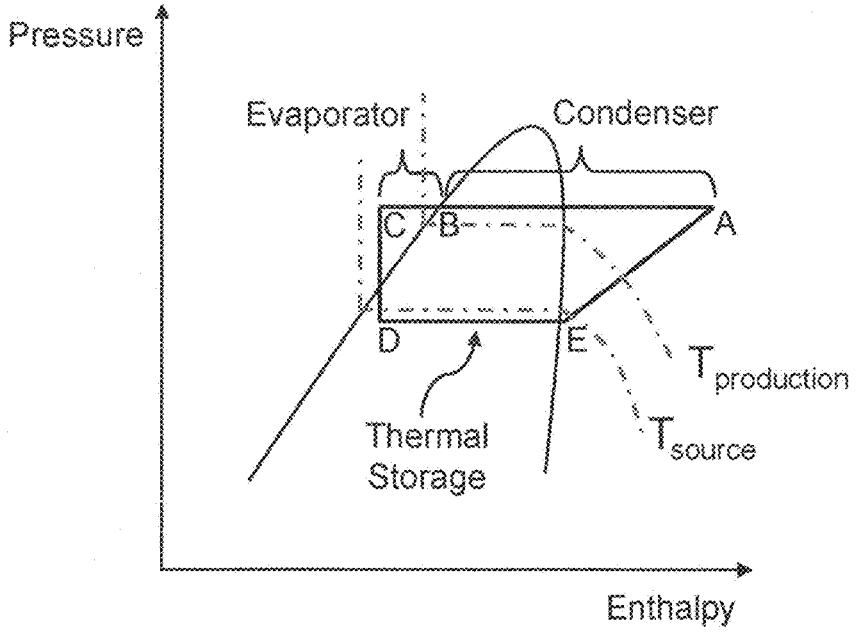
FIG. 4 is a graph showing the pressure-enthalpy curve corresponding to the defrosting mode of the heat pump system shown in FIG. 3.

The defrosting mode of the heat pump system 10 will now be described with particular reference to FIGS. 3 and 4. The four-way valve 42 is configured to switch the heat pump system to operate in the defrosting mode, upon determining that ice is formed on a surface of the evaporator 20. The switching assembly 40 is configured to directly couple the condenser 14 to the evaporator 20, and to couple the thermal energy storage device 16 to the compressor 12. According to this configuration, the flow of refrigerant exiting the condenser 14 is directed through, sequentially, the four-way valve 42, the evaporator 20, the expansion device 18, the thermal energy storage device 16, before being directed back through the four-way valve 42 on its way to the compressor 12, via the phase separator 22. In this way, the switching assembly 40 is configured to reverse the flow direction of the refrigerant through the thermal energy storage device 16, the expansion device 18 and the evaporator 20. Accordingly, it will be appreciated that the inlets and outlets of each of the relevant components of the refrigerant circuit are reversed when switching between the normal heating and defrosting modes of the heat pump system 10.

As with the normal heating mode, the defrosting mode commences with the compressor 12 extracting vapour from the liquid/vapour separator 22 and increases its pressure and temperature. The superheated refrigerant vapour is directed to the condenser 14 where it transfers heat into the building at the heat production temperature (e.g., 65° C.). This causes the gaseous refrigerant to condense into a warm liquid at a higher residual temperature (e.g. approximately 70° C.).

After exiting the condenser 14, the warm liquid refrigerant is directed to the evaporator 20 where it causes the ice on the external surfaces of the evaporator 20 to melt. As a result, the warm liquid refrigerant is sub-cooled by the evaporator 20. The sub-cooled liquid refrigerant then passes to the expansion device 18 which reduces its temperature and pressure further. The refrigerant is then directed to the thermal energy storage device 16 where it absorbs thermal energy from the phase change material, and becomes a super-heated vapour. This super-heated vapour refrigerant is finally, directed to the separator 22 before commencing the next defrosting mode cycle. During the defrosting mode, the external fan 34 is powered off whilst the evaporator 20 is defrosted.

In an exemplary arrangement of the heat pump system 10, an internal fan may be provided to direct air across the condenser 14. The internal fan may be powered on when operating the heat pump system 10 in the defrosting mode, to increase the efficiency of the heat transfer from the condenser 14 to a building interior, for example.

The thermodynamic characteristics of the defrosting mode are described with reference to the p-h curve shown in FIG. 4. The defrosting mode cycle starts with hot refrigerant vapour from the compressor 12 (as indicated by point A on the p-h curve) condensing in the condenser 14 at a temperature of approximately 70° C. The refrigerant leaves the condenser 14 and enters the evaporator 20 at a temperature of approximately 70° C. (B). In this situation, the evaporator 20 functions as a sub-cooler of the refrigerant circuit, and it absorbs heat from the warm liquid refrigerant and cools it down to a sub-cooled liquid to a temperature that is a few degrees higher than the temperature of the evaporator 20 (e.g. approximately 40° C.), which varies during the defrosting operation as the ice melts away.

The temperature of the refrigerant at the evaporator 20 increases as the amount of ice reduces, and until all of it melts away (i.e. until the evaporator is fully defrosted). The sub-cooled refrigerant is then directed through the expansion device 18. After the expansion of the refrigerant in the expansion device 18, it takes the form of a saturated mixture of gas and liquid at a temperature below 30° C. (e.g., approximately 25° C.) (D). The refrigerant then enters the thermal energy storage device 16, whereupon it is evaporated and superheated to a temperature of approximately 25° C. Finally, the refrigerant is directed through the separator 22 and onwards towards the compressor 12, whereupon the cycle starts again (E).

It will be appreciated that during the defrosting mode, the thermal energy which is recovered by the thermal energy storage device 16 during the normal heating mode, is used as a heat source to provide heat to building. The use of the thermal energy storage device 16 as an auxiliary heat source increases the COP of the heat pump system 10.

In particular, when operating the heat pump system 10 in the defrosting mode, the heat pump's temperature lift (i.e. the increase in refrigerant temperature provided by the compressor 12) is less than the corresponding temperature lift for the normal heating mode. This is because the temperature of the phase change material is approximately 30° C., which is much higher than the outdoor air temperature of approximately 0° C. As a result, the COP of the heat pump system 10 during the defrosting mode is significantly higher than the normal heating mode COP. This means that the heat pump system 10 can be switched from the normal heating mode to the defrosting mode once the thermal energy storage device 16 is fully charged, even when there is no ice on the evaporator 20 in order to achieve the higher COP.

To demonstrate the performance difference between normal heating and defrosting modes, a representative simulation of each of the modes has been conducted based on data obtained from a commercially available simulation software.

For the normal heating mode simulation, the parameters were determined to be:

Outdoor air temperature: 0° C.
Output temperature of the condenser: 65° C.
Isentropic efficiency of the compressor: 75%
Melting temperature of the phase change material: 30° C.
5° C. approach temperature difference of the condenser (e.g. the smallest temperature difference between the refrigerant in the refrigerant circuit and the heat transfer fluid in the central heating system of the building).
10° C. approach temperature difference of the thermal energy storage device (e.g. when the thermal energy storage device is used as the heat source).

The results of the normal heating mode simulation are summarised as follows:

Mass flow rate of refrigerant: 0.027 kg/s
Evaporating pressure: 2 bar
Condensing pressure: 21.28 bar
Compressor power consumption: 1.486 kW (5348 kJ/h)
Heat power output: 4 kW (=14500 kJ/h)
Heat extracted from outdoor air: 2.514 kW (8182 kJ/h)
COP=14500/5348=2.7
Enthalpy of refrigerant at state point B, hB=295.51 kJ/kg
Enthalpy of refrigerant at state point C, hC=248.77 kJ/kg
Enthalpy difference: $\Delta h = hB - hC = 47$ kJ/kg
Heat recovered by the thermal energy storage device: $m*(hB-hC)=0.027*47=1.26$ kW For the defrosting mode simulation, the parameters were determined as follows:

Thermal energy storage device temperature: 30° C.
Output temperature of the condenser: 65° C.
Isentropic efficiency of the compressor: 75%
5° C. approach temperature difference in condenser.
10° C. approach temperature of the thermal energy storage device (e.g. when the difference when the thermal energy storage device is used as the heat source).

The results of the defrosting mode simulation are summarised as follows:

Mass flow rate of refrigerant: 0.029 kg/s
Evaporating pressure: 6.6 bar
Condensing pressure: 21.28 bar
Compressor power: 0.92 kW (3334 kJ/h)
Heat output from the condenser: 4 kW (=14400 kJ/h)

Heat extracted from thermal energy storage device: 3.1 kW (11200 kJ/h)

COP=14500/3334=4.35

From the results of these simulations, it is clearly demonstrated that the defrosting mode COP (4.35) is significantly higher than the normal heating mode COP (2.7). The higher COP of the defrosting mode means that the heat pump system 10 can be preferentially switched from the normal heating mode to the defrosting mode once the thermal energy storage device 16 has been fully charged. It is envisaged that in certain situations it would be advantageous to configure the heat pump system 10 to periodically, and repeatedly operate in the defrosting mode in order to prevent formation of frost, or ice, on the external surface of the evaporator 20.

In view of the above, it is necessary to determine how long and how often the heat pump system 10 should be operated in the normal heating and/or defrosting modes in order to optimise the performance of the system over time. According to the above simulations, the thermal energy storage device 16 is able to recover heat from the warm refrigerant at a rate of 1.26 kW during the normal heating mode. This recovered heat can be transferred back into the refrigerant from the thermal energy storage device 16 at a rate of 3.1 kW, during the defrosting mode.

A scenario is considered in which the heat pump system 10 is operated in the normal heating mode until the thermal energy storage device 16 is fully charged, and then the defrosting mode is engaged in order to fully discharge the recovered heat into the refrigerant circuit 26. Assuming that there is an energy balance in the system, all the heat that is transferred into the thermal energy storage device during the normal heating mode can be discharged during in defrosting mode such that:

$$\text{Charging time}*\text{charging rate}=\text{discharging time}*\text{discharging rate} \quad (1)$$

Then, rearranging equation (1) to obtain:

$$\text{Charging time/discharging time}=\text{discharging rate/charging rate}=3.1/1.26=2.46 \quad (2)$$

From equation (2) the heat pump system 10 must be operated in the normal heating mode for 2.46 units of time in order to fully charge the thermal energy storage device. It would then take 1 unit of time to fully discharge the thermal energy storage device 16.

It will be appreciated that the specific units of time spent in each of the normal and defrosting modes will depend on the capacity of the thermal energy storage device 16, and that the ratio of time will also depend on the melting temperature of the phase change material, which determines the amount of thermal energy that can be recovered when operating in the normal heating mode. The time spent in each of the operating modes will also be dependent on the temperature at which thermal energy can be discharged from the thermal energy storage device during the defrosting mode. Therefore, an optimal operating condition of the heat pump system will be determined with appreciation of the trade-off between these two configurations of the thermal energy storage device (i.e. the transference of thermal energy to and from the refrigerant circuit).

Figure 8:
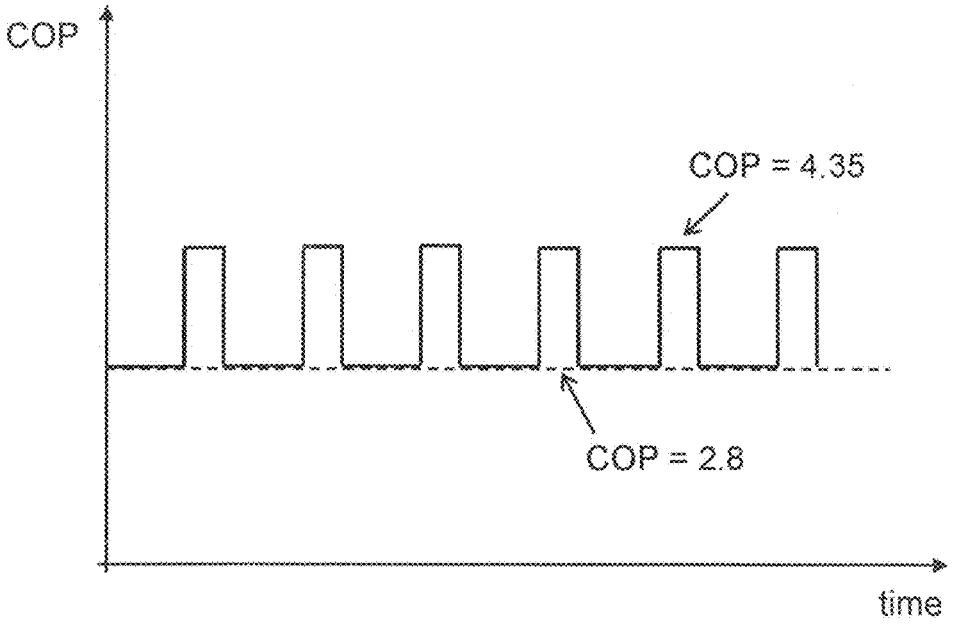
FIG. 8 is a graph showing the coefficient of performance vs. time corresponding to a method of operating the heat pump systems shown in FIG. 1, 3 or 5.

Periodically switching between the normal heating and defrosting modes, as shown in FIG. 8, is considered to provide a more efficient use of the thermal energy which is recovered by the thermal energy storage device 16, and it also makes use of the higher COP of the defrosting mode. The time ratio calculated from equation 2 is used to calculate the percentage of time that the system can operate in the defrosting mode to benefit from its higher COP:

$$1/(1+2.46)*100\%=28.9\% \quad (3)$$

The average COP for the operation period shown in FIG. 8 is calculated as:

$$\text{Average COP}=(2.8*2.46+4.35*1)/(2.46+1)=3.24 \quad (4)$$

By comparing the result of equation 4 with an alternative scenario in which only the normal heating mode is utilised (i.e. no defrosting mode), then the COP improvement percentage can be calculated as:

$$(3.24-2.8)/2.8*100\%=15.7\% \quad (5)$$

Therefore, by regularly switching between the normal heating and defrosting modes (as shown in FIG. 8) the COP of the heat pump system 10 can be increased by 15.7%, in comparison with a heat pump system which does not recover the residual heat from the condenser.

In summary, the heat pump system 10 exhibits a significantly higher COP when it operates in the defrosting mode. Furthermore, it has been shown that by periodically switching between the normal heating and defrosting modes it is possible to achieve a higher system COP for a greater proportion of the operational life of the heat pump system (even when there is no ice on the evaporator 20).

During the normal heating mode, the sub-cooling of the refrigerant by the thermal energy storage device 16 reduces the irreversible throttling losses which are caused by refrigerant flowing through the expansion device 18. In this way, the transfer of heat into the energy storage device 16 increases the COP of the heat pump system 10.

In addition, by not having to provide additional electrically powered heating to defrost the evaporator, the present disclosure achieves efficiency gains of between 5-10% over known heat pump systems.

Moreover, by regularly switching to the defrosting mode in order to utilise the waste heat recovered from sub-cooling heat, it is possible to further improve the COP of the system by 15.7% compared to a heat pump which does not recover such waste heat from the condenser in the case study. It will be appreciated that the changes in the COP of the system will depend on the specific configurations and operating conditions of the system.

With reference to FIGS. 5 to 8, an alternative heat pump system according to a second arrangement of the present disclosure will now be described.

Figure 5:
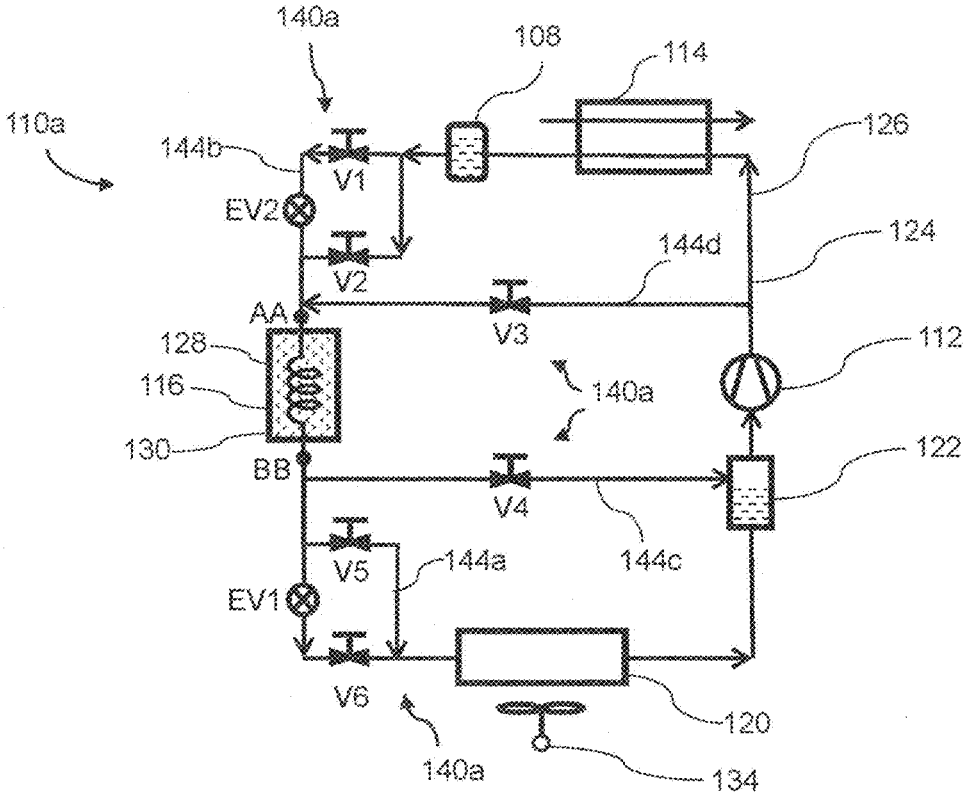
FIG. 5 is a schematic diagram of a single stage heat pump system according to a second arrangement of the present disclosure, the heat pump system being configurable to operate in a plurality of different operating modes.

For brevity, features in FIG. 5 and the functioning thereof that are the same or similar to those features already described with reference to FIGS. 1 and 3 are given similar reference numerals as in FIGS. 1 and 3 but increased by 100, and where appropriate appended with the suffix "a" for distinction with later arrangements, and will not be described in detail again.

The heat pump system 110*a* is configured to provide a flexible, multi-mode air-source heat pump which utilises a novel defrosting mechanism and is capable of continuous heating of a building into which it is installed.

Similar to the previously described system, as shown in FIGS. 1 and 3, the heat pump system 110*a* includes a compressor 112, a condenser 114, a thermal energy storage device 116, a first expansion device EV1 (e.g. a first expansion valve), an evaporator 120 and a phase separator 122, which are fluidly connected in sequence by a fluid conduit 124 so as to define a refrigerant circuit 126. An external fan 134 is provided to direct a flow of air across the coils, or fins, of the evaporator 120 in order to improve its operating efficiency.

The heat pump system 110*a* further comprises a refrigerant storage device 108 which is arranged between the condenser 114 and the thermal energy storage device 116. The refrigerant storage device 108 comprises a vessel, or tank, which is configured to hold a volume of the refrigerant, as would be readily appreciated by the skilled person. The refrigerant storage device 108 is configured to compensate for any fluctuations in the refrigerant volume flowing within the fluid circuit 124. For example, the heat pump system 110*a* is configured during a defrosting mode to hold a volume of refrigerant in the evaporator 120 (as explained below). In this situation, the refrigerant storage device 108 is configured to compensate for the reduction in refrigerant volume which is circulated within the circuit.

The thermal energy storage device 116 comprises a phase change material which is housed within a case 130 that is configured to allow direct thermal contact with a conduit section 128 of the refrigerant circuit 126. The thermal energy storage device 116 is configured to passively transfer thermal energy between the phase change material and the refrigerant in the refrigerant circuit 126.

Figure 7:
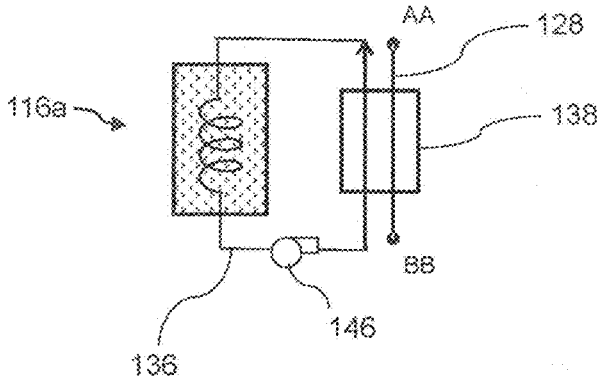
FIG. 7 is a schematic diagram of a thermal energy storage assembly of the heat pump systems shown in FIG. 1, 3 or 5.

According to an alternative exemplary arrangement, a thermal energy storage device 116*a* is arranged such that the phase change material is thermally coupled by a heat transfer fluid circuit 136 to the conduit section 128 of the refrigerant circuit 126, as shown in FIG. 7. A heat transfer fluid (e.g. water) is directed through the secondary circuit 136 by a mechanical fluid pump 146, and is thermally coupled by a heat exchanger 138 to the first refrigerant in the first refrigerant circuit 126. It will be appreciated that the thermal energy storage device 116*a* may be coupled into the refrigerant circuit 126 between the points AA-BB, as shown in FIGS. 1 and 5.

The thermal energy storage device 116*a* is configured such that the transfer of heat into the refrigerant circuity 126 can be actively controlled by the operation of the pump 146, as would be understood by the skilled person.

The heat transfer fluid circuit 136 may be arranged outside of the heat pump system. As such, it may be configured with a large heat storage capacity (as compared to an internally arranged phase change material thermal energy storage unit). The heat transfer fluid circuit 136 is configured to operate at atmospheric pressure, which means it can be made from components which are simple to manufacture and control (e.g. lower cost).

The heat pump system 110*a* has four different operational modes which are referred to as a normal heating mode, a defrosting mode, an auxiliary heating mode, and a heat charging mode. The four modes correspond, respectively, to modes 1, 2, 3, and 4 as outlined in Table 1, below.

TABLE 1

| Four operational modes (valves - open/closed, fan - on/off) | | | | | | | | |
|---|---|---|---|---|---|---|---|---|
| Mode | Cycle (FIG. 6) | V1 | V2 | V3 | V4 | V5 | V6 | Fan |
| 1 | A-B-C-D-E-A | Closed | Open | Closed | Closed | Closed | Open | On |
| 2 | G-B-H-F-G/F-I | Open | Closed | Closed | Open | Open | Closed | Off |
| 3 | F-G-B-H-F | Open | Closed | Closed | Open | Closed | Closed | Off |
| 4 | J-K-L-E-J | Closed | Closed | Open | Closed | Closed | Open | On |

The heat pump system 110*a* includes a switching assembly 140*a*, which is configured to control the flow of refrigerant around the refrigerant circuit 126 in order to switch between the different operating modes of the heat pump system 110*a*.

In particular, the switching assembly includes six control valves V1, V2, V3, V4, V5, V6 which are independently configurable in order to achieve the required operating mode. The switching assembly 140*a* further comprises four bypass assemblies, or fluid conduits, 144*a*, 144*b*, 144*c*, 144*d*, which are configured to bypass different components and sections of the refrigerant circuit 126 according to the required operating mode.

Figure 9:
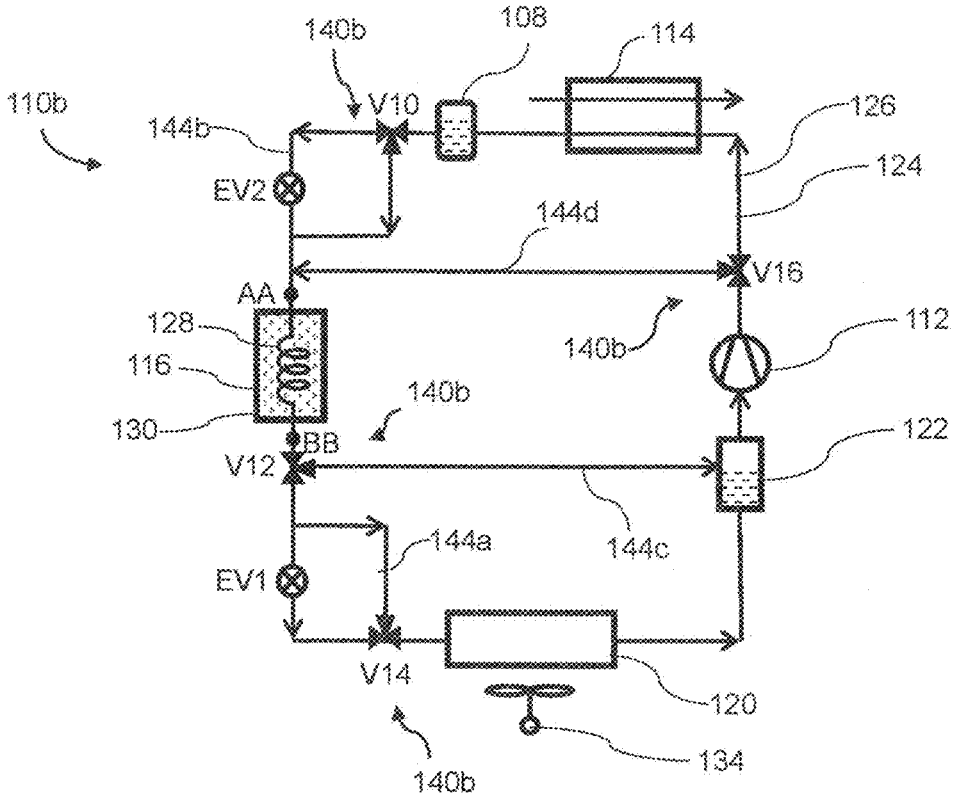
FIG. 9 is a schematic diagram of an alternative configuration of the single-stage heat pump system shown in FIG. 5.

According to an alternatively exemplary arrangement of the heat pump system 110*b*, the six two-way control valves V1-6 are replaced with four three-way valves V10, V12, V14, V16, as shown in FIG. 9, which define a switching assembly 140*b* of the system. It will be appreciated that the operation of the heat pump system 110*b* as shown in FIG. 9 is substantially the same as that in FIG. 5.

Table 1 also outlines the different combinations of valve configurations (i.e. open/closed) that are required in order to configure the heat pump system 110*a* in the four operating modes. Also included in the table is the required operating state (i.e. on/off) of the external fan 134, corresponding to each of the four system operating modes.

Figure 6:
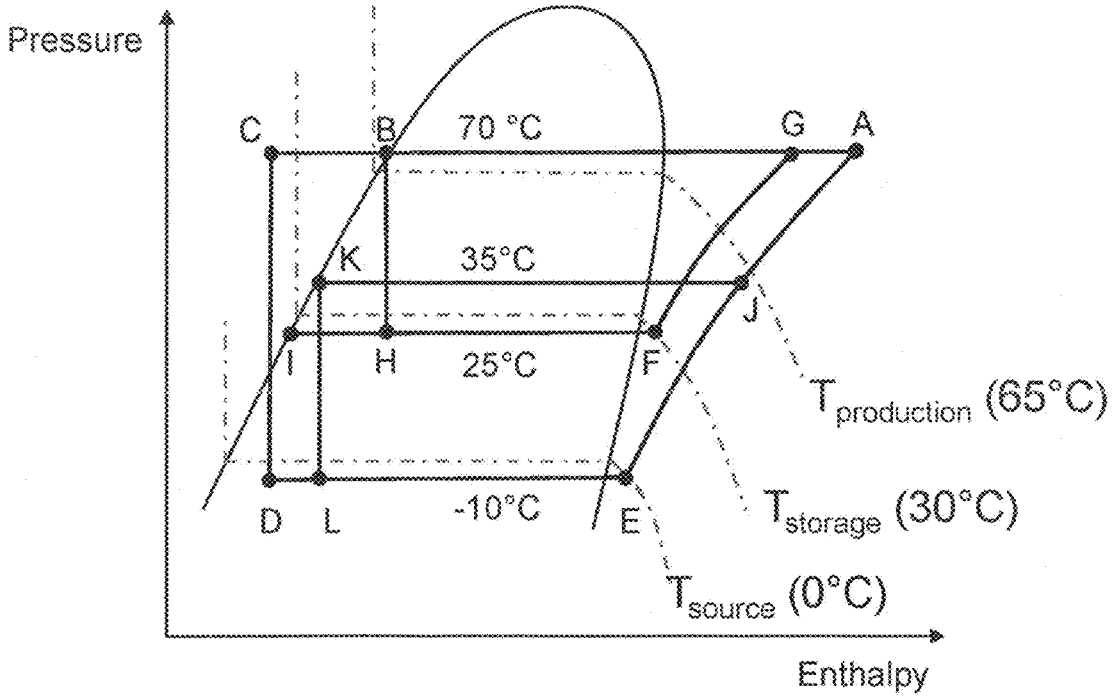
FIG. 6 is a graph showing the pressure-enthalpy curve corresponding to the different operating modes of the heat pump system shown in FIG. 5.

When operating the heat pump system 110*a* in the normal heating mode (i.e. mode 1), the refrigerant from the compressor 112 is directed through, sequentially, the second control valve V2, the thermal energy storage device 116, the first expansion valve EV1, the sixth control valve V6, the evaporator 120, the phase separator 122, and then returns to the compressor 112 to start a new cycle. In this mode, the heat pump system 110*a* operates as a normal single-stage heat pump, such that heat which is extracted from the outdoor air is released into the building by the condenser 114. The thermal energy storage device 116 works as a sub-cooler to recover heat from the warm liquid refrigerant which exits from the condenser 114. As a by-product, the liquid refrigerant is sub-cooled by the transfer of thermal energy from the refrigerant into the phase change material within the thermal energy storage device 116. The recovered heat is stored in the phase change material such that it can be used in a subsequently activated operation mode the heat pump system 110*a*. The thermodynamic cycle corresponding to the normal heating mode is described by the points "A-B-C-D-E-A", as shown in the pressure-enthalpy (p-h) curve which is shown in FIG. 6.

When operating the heat pump system 110*a* in the defrosting mode (i.e. mode 2), the switching assembly 140*a* is configured to direct thermal energy to both the evaporator and the condenser, as described in relation to the previous embodiment. This is achieved by directing refrigerant through a second expansion device EV2 (e.g. an expansion valve) which is fluidly coupled to the refrigerant circuit 126 between the condenser 114 and the thermal energy storage device 116, by the second bypass assembly 144*b*. The switching assembly 140*a* is also arranged to bypass the first expansion valve EV1 by diverting refrigerant through the first bypass assembly 144*a*, which is configured to isolate the first expansion valve EV1 from the refrigerant circuit 126.

Specifically, the refrigerant exiting the compressor 112 is directed to flow through the first control valve V1, the second expansion valve EV2 where it expands, thereby reducing pressure and temperature. Accordingly, the expansion valve EV2 is configured to reduce the temperature of the refrigerant to below the operating temperature of the thermal energy storage device 116, which ensures that thermal energy will be transferred from the storage device 116 into the refrigerant. It is also configured to balance the pressure of the refrigerant within the refrigerant circuit.

Following on from the second expansion valve EV2, the refrigerant is then directed through the thermal energy storage device 116 where it turns into superheated refrigerant vapour. In this way, the thermal energy storage device 116 works as an evaporator and a super heater. Upon exiting the thermal energy storage device 116 the refrigerant is split into two streams, with a first stream being directed through, sequentially, the fourth control valve V4, the third bypass assembly 144*c*, the phase separator 122 and, finally, the compressor 112.

The second stream is directed through the fifth control valve V5, the second bypass assembly 144*b* and then into the evaporator 120. According to the defrosting mode configuration of the heat pump system 110*a*, the thermal energy storage device 116 is thermally coupled to the refrigerant circuit 126 at a point which sits between the second expansion valve EV2 and the evaporator 120. In this way, the refrigerant vapour flowing past the thermal energy storage device 116 is caused to release its latent heat to melt the ice on the external surfaces of the evaporator 120. The liquid refrigerant which is formed during this condensing process is temporarily held in the evaporator 120 until the system is switched to the normal heating mode.

The first stream of refrigerant exiting the thermal energy storage device 116 is directed to the condenser 114 to provide heat to the building, whereas the second refrigerant stream is used to defrost the evaporator 120. Accordingly, the system provides continuous heat to the interior of the building during the evaporator defrosting process.

With reference to FIG. 6, the continuous heating cycle of the first refrigerant stream is represented by the sequence "G-B-H-F-G" and the second refrigerant stream is represented by the sequence "G-B-H-F-I". In particular, the sequence "F-I" represents the heat which is released by the stream of super-heated refrigerant vapour as it enters the evaporator 120 via the first bypass assembly 144*a*.

When operating in the defrosting mode, the switching assembly 140*a* directs heat which is recovered from the refrigerant from the condenser (which is normally wasted in the throttling process) as heat source for defrosting the evaporator 120, which thereby removes the need for additional thermal energy input for evaporator defrosting.

The heat pump system is operable in an auxiliary heating mode in which thermal energy is transferred from the thermal energy storage device 116 into the refrigerant without any input from the evaporator 120. To achieve this, the switching assembly 140*a* is configured to bypass the expansion valve EV1 and the evaporator 120.

In particular, the refrigerant from the compressor 112 is directed to flow through, sequentially, the condenser 114, the first control valve V1, the first expansion valve EV1, the thermal energy storage device 116, the fourth control valve V4, the third bypass assembly 144*c*, the phase separator 122, and finally it returns to the compressor 112 to start a new cycle. In this mode, the thermal energy storage device 116 operates as an evaporator of the system, and the heat stored in the thermal energy storage device 116 is used as an auxiliary heat source. The corresponding thermodynamic cycle is represented by "F-G-B-H-F" as shown in FIG. 6.

Similar to the defrosting mode in the first embodiment (as shown in FIGS. 1 to 4), the auxiliary heating mode of the present embodiment is configured to exhibit a higher COP than the normal heating mode. For example, in an exemplary arrangement of the heat pump system 110*a* the COP values for the normal heating and auxiliary heating modes are 2.8 and 4.35, respectively. This is because, in the auxiliary heating mode, the thermal energy storage device 116 replaces the evaporator 120 as the primary heat source for the system. The phase change material transfers heat into the refrigerant at a significantly higher temperature (~30° C.) compared to the outdoor air (~0° C.), which leads to a higher COP rating (for the same reasons as explained with reference to the first embodiment).

An exemplary operating scheme for the heat pump system 110*a* involves periodically and repeatedly switching between the two heating modes, as shown in FIG. 8. The timings and duration of each switch is determined such that 28.9% of the time is spent in the auxiliary heating mode, which achieves a 15.7% increase in the COP compared with just using the normal heating mode alone. A further advantage of the heat pump system 110*a* is that the switching assembly 140*a* enables the refrigerant circuit 126 to be readily switched between the normal heating mode (e.g. in order to charge the thermal energy storage 116) and the auxiliary heating mode (e.g. in order to utilise the stored thermal energy), which thereby increases the flexibility of the system.

The heat pump system 110*a* is also operable in a heat charging mode (i.e. mode 4) in which thermal energy is transferred from the refrigerant to the thermal energy storage device 116. In this mode, the switching assembly 140*a* is configured to direct refrigerant exiting the compressor 112 to bypass the second expansion valve EV2 and the condenser 114.

When operating in the heat charging mode, the refrigerant from the compressor is directed to flow through, sequentially, the third control valve V3, the fourth bypass assembly 144*d*, the thermal energy storage device 116, the first expansion valve EV1, the evaporator 120, the phase separator 122, and then it returns to the compressor 112 to start a new cycle.

In this heat charging mode, it is possible to shut down the condenser 114 and use the thermal energy storage device 116 as a secondary condenser. This operation mode is particularly advantageous in situations where there is no heat demand from the building but the outdoor temperature is high, such that heat can efficiently extracted from the external environment and stored in the thermal energy storage device 116 for later use. Such a situation may arise, for example, when there are no people present in the building during the day. The corresponding thermodynamic cycle is represented by "E-J-K-L-E" as shown in FIG. 6.

In known single-stage heat pump systems, heat is stored at the operating temperature of the condenser (i.e. heat may be absorbed from the refrigerant as it flows between the compressor and the condenser). The heat charging mode according to the present disclosure causes heat to be absorbed by thermal energy storage device 116 at an intermediate temperature (i.e. the heat is transferred from the refrigerant as it flows from the condenser). By configuring and operating the heat pump system in this way, the heat charging mode reduces the capacity of the thermal energy storage by 1/COP whilst maintain the operating temperature of the condenser. Accordingly, the heat pump system 110*a* can be configured with a relatively small thermal energy storage capacity, which reduces the complexity and cost of the system. According to the exemplary case study described above, the COP of the heat charging mode is 4.35. Therefore, the thermal energy storage capacity can be reduced by 1/4.35=23%.

According to an alternative exemplary arrangement, a thermal energy storage device 116*a* is arranged such that the phase change material is thermally coupled to a conduit 128 of the refrigerant circuit 126 by a heat fluid transfer circuit 136, as shown in FIG. 7. A heat transfer fluid, such as water, is directed through the second circuit 136 by fluid pump 146. The heat transfer fluid in the second refrigerant circuit 136 is thermally coupled by a heat exchanger 138 to the refrigerant in the first refrigerant circuit 126.

The thermal energy storage device 116*a* is configured such that the transfer of heat into the refrigerant circuity 126 can be actively controlled by the operation of the pump 146, as would be understood by the skilled person. This is in contrast the arrangement shown in FIG. 5, for example, in which the thermal energy storage device 116 is configured to passively transfer energy into, and out of, the refrigerant circuit 126.

Advantageously, the thermal energy storage device 116*a* can be arranged outside of the heat pump system 110*a*, and can therefore be configured with a bigger heat capacity (i.e. bigger volume of phase change material). The larger capacity thermal energy storage device 116*a* can be used to store heat in when off-peak electricity and/or warm air is more freely available, but when the heat demand in the building is low.

Double-Stage Heat Pump System

The previously described heat pump systems 10, 110*a*, 110*b* are all single stage heat pump systems, since they each comprise only a single refrigerant circuit 26, 126. A number of double-stage heat pump systems 210*a*, 210*b*, 210*c* according to another aspect of the present disclosure will now be described with reference to FIGS. 10 to 17.

For brevity, the features in FIGS. 10 to 17 and the functioning thereof that are the same or similar to those features already described with reference to FIGS. 1 to 9 are given similar reference numerals, but increased by 100, and will not be described in detail again.

Figure 10:
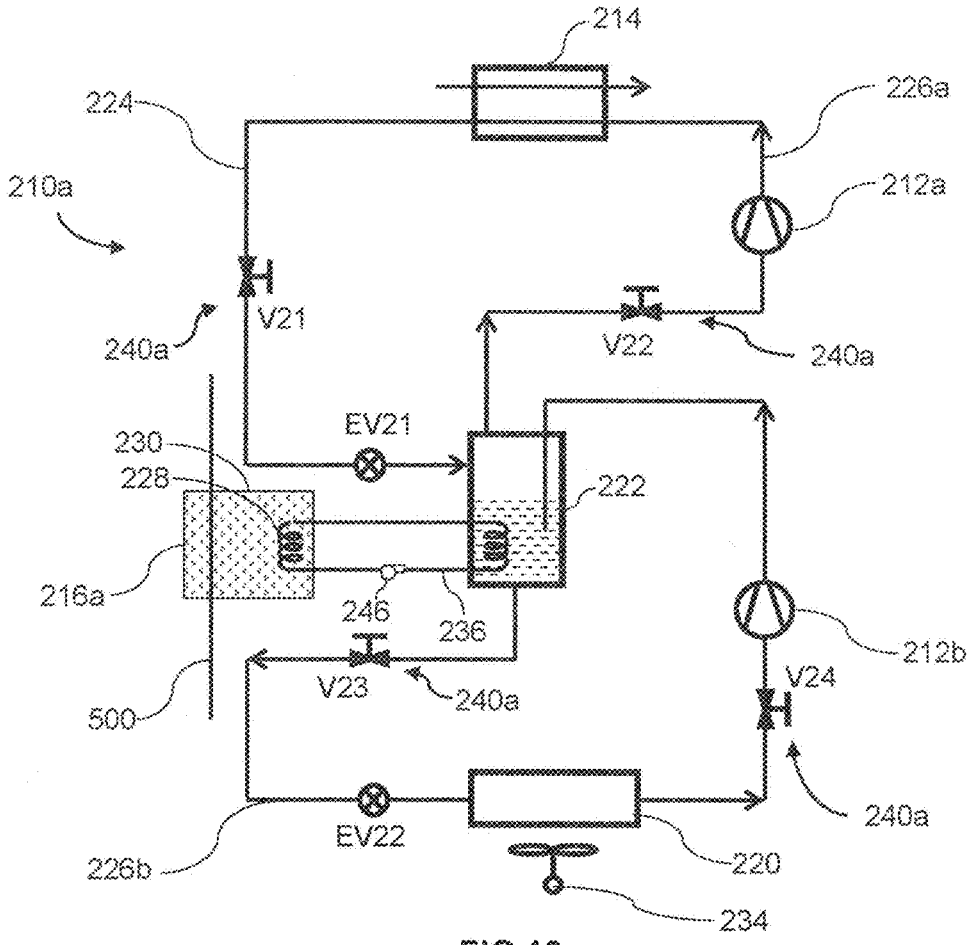
FIG. 10 is a schematic diagram of a double stage heat pump system according to a third arrangement of the present disclosure, the heat pump system being configurable to operate in a plurality of different operating modes.

With reference to FIG. 10, the heat pump system 210*a* includes a first compressor 212*a*, a condenser 214 and a first expansion device EV21 (e.g. a first expansion valve), which are fluidly connected in sequence by a fluid conduit 224 so as to define a first refrigerant circuit 226*a*. The heat pump system 210*a* further comprises a second compressor 212*b*, a second expansion device EV22, and an evaporator 220, which are fluidly connected in sequence by a fluid conduit 224 so as to define a second refrigerant circuit 226*b*.

A two-phase gas-liquid separator 222 (e.g. a flash tank) is fluidly coupled between the first and second refrigerant circuits 226*a*, 226*b*. The first refrigerant circuit 226*a* is coupled to a gas containing portion (e.g. upper portion) of the phase separator 222 whereas the second refrigerant circuit 226*b* is coupled to a liquid containing portion (e.g. lower portion). The phase separator 222 is arranged upstream from the first compressor 212*b*, downstream from the first expansion device EV21, downstream from the second compressor 212*b* and upstream from the second expansion device EV22, as shown in FIG. 10. During operation of the heat pump system 210*a*, the conduit downstream from the expansion device EV21 contains a liquid-gas mixture of refrigerant. Accordingly, the output of high-pressure stage may be fluidly coupled to either the liquid containing portion or the gas containing portion of the phase separator 222. The input of the high-pressure stage is fluidly coupled to the gas-containing portion, as shown in FIG. 10.

During operation of the heat pump system 210*a*, the refrigerant in the first circuit 226*a* is circulated at a higher pressure and temperature than the refrigerant in the second circuit 226*b*. Accordingly, the first and second refrigerant circuits 226*a*, 226*b* represent high-pressure/temperature and low-pressure/temperature stages of the heat pump system 210*a*, respectively. The phase separator 222 is fluidly coupled between the refrigerant circuits 226*a*, 226*b* at a position which represents an intermediate pressure/temperature state within the heat pump system 210*a*.

Each of the high-pressure and low-pressure stages are configured to transfer thermal energy from one position to another within their respective refrigerant circuits 226*a*, 226*b*. For example, when the heat pump system 210*a* is operating in a heating mode, the high-pressure stage transfers heat from the phase separator 222 to the condenser 214 whereas the low-pressure stage transfers heat from the evaporator 220 to the phase separator 222. Accordingly, the first and second refrigerant circuits 226*a*, 226*b* are effectively two single-stage heat pump systems coupled together by the phase separator 222.

The double-stage heat pump system 210*a* is adapted for situations where the temperature differences between the outdoor and indoor environments (i.e. the temperature lift) is large, for example between 50° C. to 70° C. According to an exemplary operating condition of the heat pump system 210*a*, the ambient air temperature may be within a range of −10° C. to 10° C. (i.e. at the evaporator 220). A building's central heating system may require heat to be produced at a temperature of between 50° C. and 60° C. (i.e. at the condenser 214). In this situation, the phase separator 222 is arranged within the heat pump system 210*a* at an intermediate temperature of between 20° C. to 30° C. Accordingly, the temperature lift provided by each of the low-pressure and high-pressure stages is around 25° C. to 35° C.

The double-stage heat pump system 216*a* is also configured to operate at a higher COP than an equivalent single-stage heat pump system operating at the same temperature lift. For example, the double-stage heat pump system 210*a* has two compressors so that the pressure difference across each compressor (i.e. the pressure ratio) can be reduced, compared to the single compressor in a single-stage heat pump system. The phase separator 222 is configured to remove 'flashed' gas at the intermediate pressure so that the gas is not throttled to the evaporating pressure only to be recompressed again, which thereby saves compression power. The phase separator b 222 also provides intercooling to the gas exiting from the low-pressure stage compressor 212*b*, further reducing the compression power required by the high-pressure stage compressor 212*a*.

At least some of the problems associated with operating known single-stage heat pump systems also apply to known double-stage heat pump systems. For example, a known double-stage heat pump system is configured to defrost its outdoor heat exchanger by either extracting heat from an indoor heat exchanger (i.e., a reverse cycle method), or by extracting hot vapour generated by a compressor (i.e., a hot gas bypass method).

Each of these defrosting processes can take several minutes to fully defrost the outdoor heat exchanger. During defrosting, the indoor heat exchanger is effectively switched off, so there is no continuous heating supply from the heat pump. For this reason, a backup electrical heater is often needed to provide heating during the defrosting of the outdoor heat exchanger, which can reduce the annual average COP of the heat pump system by 5-10%.

The double-stage heat pump system 210*a* according to the present disclosure includes a thermal energy storage device 216*a* which is thermally coupled to the phase separator 222, as shown in FIG. 10. By thermally coupling the thermal energy storage device 216*a* to the phase separator 222, this enables the heat pump system 210*a* to operate more efficiently, and thereby address the problems with known double-stage heat pump systems.

The thermal energy storage device 216 comprises a phase change material which is housed within a case 230. The phase change material is thermally coupled by a heat transfer fluid circuit 236 to the phase separator 222. A heat transfer fluid (e.g. water) is directed through the heat transfer fluid circuit 236 by a mechanical fluid pump 246, and is thermally coupled by a heat exchanger 238 to the liquid refrigerant housed in the liquid containing portion of the phase separator 222.

The thermal energy storage device 216 is arranged outside of the heat pump system 216*a*. As such, it may be configured with a large heat storage capacity (as compared to an internally arranged phase change material thermal energy storage unit). Also, by having the thermal energy storage 216 arranged external to the other components of the heat pump system offers the possibility to recover waste heat from other external sources. For example, the warm wastewater from a bath or shower can be channeled through a conduit 500 that is thermally coupled to the thermal energy storage, as shown in FIG. 10.

A switching assembly 240*a* is also provided to control the flow of refrigerant within the heat pump system 210*a*, and thereby determine the operating mode of the system. The switching assembly 240*a* includes a set of valves V21, V22, V23, V24 which are configured to switch the operation of the heat pump system 210*a* between the different operating modes, as will be explained in more detail below.

Figure 11:
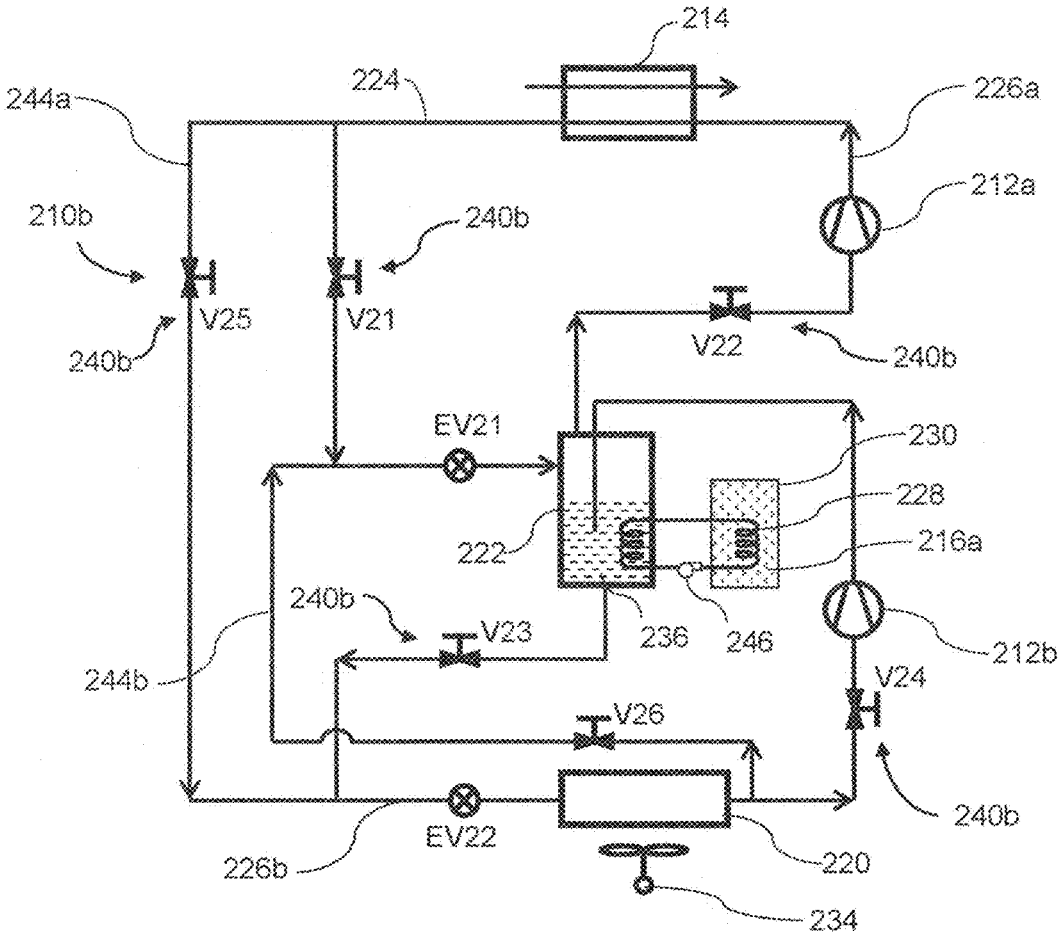
FIG. 11 is a schematic diagram of a double-stage heat pump system according to a fourth arrangement of the present disclosure, the heat pump system being configurable to operate in a plurality of different operating modes.

FIG. 11 shows an alternative double-stage heat pump system 210*b* according to the present disclosure. Heat pump system 210*b* includes substantially the same components as the heat pump system 210*a* shown in FIG. 10. However, the switching assembly 240*b* is configured differently to allow the heat pump system 210*b* to operate in a continuous heating and defrosting mode, as will be explained in more detail below.

In particular, the switching assembly 240*b* includes a first bypass assembly 244*a* that fluidly couples the first refrigerant circuit 226*a*, at a position immediately downstream from the condenser 214, to the second refrigerant circuit 226*b* at a position which is immediately upstream from the second expansion valve EV22, as shown in FIG. 11. Accordingly, the first bypass assembly 244*a* is arranged to bypass the valves V21, V23, the first expansion valve EV21 and the phase separator 222.

The switching assembly 240*b* also includes a second bypass assembly 244*b* that fluidly couples the second refrigerant circuit 226*b*, at a position immediately downstream from the evaporator 220, to the first refrigerant circuit 226*a* at a position which is immediately upstream from the first expansion valve EV21, as shown in FIG. 11. Accordingly, the second bypass assembly 244*b* is arranged to bypass the second compressor 212*b* and the switching valve V24. Switching valves V25, V26 are provided to control the flow of refrigerant through the first and second bypass assemblies 244*a*, 244*b*, respectively.

Operation of the heat pump systems 210*a*, 210*b* will now be described with reference to the pressure-enthalpy (p-h) curves shown in FIGS. 12 to 16. The heat pump system 210*a* has four operational modes which are referred to as a normal heating mode, a heat charging mode, an auxiliary heating mode and a heat booster mode. These four operating modes correspond, respectively, to modes 1, 4, 3, and 5 as outlined in Table 2, below. The heat pump system 210*b* has the same four modes as heat pump system 210*a* (i.e., modes 1, 4, 3 and 5), and it also has an additional defrosting mode, which corresponds to mode 2 in Table 2, below.

TABLE 2

| Operational modes (valves - open/closed; compressors and pump - on/off) | | | | | | | | | |
|---|---|---|---|---|---|---|---|---|---|
| Mode | C1 | C2 | Pump | V21 | V22 | V23 | V24 | V25 | V26 |
| 1 | On | On | Off | Open | Open | Open | Open | Closed | Closed |
| 4 | Off | On | On | Closed | Closed | Open | Open | Closed | Closed |
| 3 | On | Off | On | Open | Open | Closed | Closed | Closed | Closed |
| 5 | On | On | On | Open | Open | Open | Open | Closed | Closed |
| 2 | On | Off | On | Open | Open | Closed | Closed | Open | Open |

Table 2 outlines the different configurations of the valves V21-V26 (i.e. open/closed), pump 246 (i.e. on/off) and compressors 212*a*, 212*b* (i.e. on/off) which are required in order to operate the heat pump systems 210*a*, 210*b* in the different modes.

Figure 12:
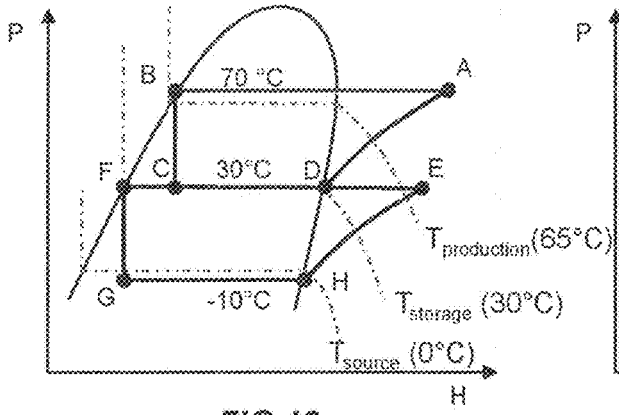
FIGS. 12 to 16 are graphs showing the pressure-enthalpy curve corresponding to the different operating modes of the heat pump system shown in FIG. 11.

When operating the heat pump systems 210*a*, 210*b* in the normal heating mode (i.e. mode 1), the compressors 212*a*, 212*b* are switched on, the switching valves V21-V24 are opened and the pump 246 is switched off. Additionally, for heat pump system 212*b*, the valves V25, V26 are closed. Accordingly, the refrigerant in the high-pressure stage is directed by the first compressor 212*a* through, sequentially, the condenser 214, the first valve V21, the first expansion valve EV21, the phase separator 222, the second valve V22, and then returns to the compressor 212 to start a new cycle. Simultaneously, the refrigerant in the low-pressure stage is directed by the second compressor 212*b*, sequentially, the phase separator 222, the third valve V23, the second expansion valve EV22, the evaporator 220, the and fourth valve V24 and then returns to the second compressor 212*b* to start a new cycle. In this mode, the heat pump system 110*a* operates as a normal double-stage heat pump, such that heat which is extracted from the outdoor air is released into the building by the condenser 214. The thermodynamic cycles corresponding to the high-pressure and low-pressure stages during the normal heating mode is shown in FIG. 12.

Figure 13:
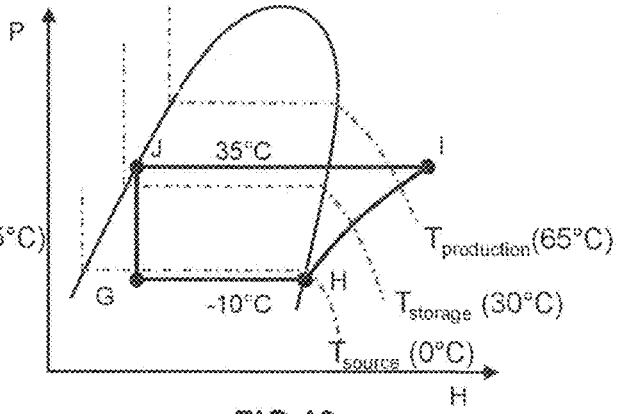

During the charging mode (i.e., mode 4), the valves V21, V22, V25, V26 are closed and the first compressor 212*a* is switched off. Thus, the high-pressure stage is deactivated. Meanwhile, the valves V23 and V24 remain open, and the second compressor 212*b* is switched on. In addition, the pump 246 is switched on to direct heat between the phase separator 222 and the thermal energy storage device 216*a*, 216*b*. Accordingly, the phase separator 222 in combination with the TES 216*a*, 216*b* becomes a condenser, effectively, for the low-pressure stage of the heat pump system 210*a*, 210*b*. This can be achieved by controlling the pressure within the phase separator 222. As a result, heat from the outdoor air is transferred by the low-pressure stage to the intermediate temperature range whereupon it is used to charge the thermal energy storage device 216*a*, 216*b*. The thermodynamic cycle corresponding to the heat charging mode is described by the points "H-I-J-G-H", as shown in FIG. 13.

This operating mode is particularly suited to conditions when heat may not be needed, for example during the day when the building's occupants are away but the outdoor temperature is warm (i.e., a high COP condition). The thermal energy collected in the thermal energy storage device 216*a*, 216*b* is stored for later use, for example when the building's occupants return in the evening, the outdoor temperatures are lower, and the heat demand is high. Once the phase charge material in the thermal energy storage device 216*a*, 216*b* is fully charged, the low stage can also be shut down by switching of the second compressor 212*b* and the pump 246.

Figure 14:
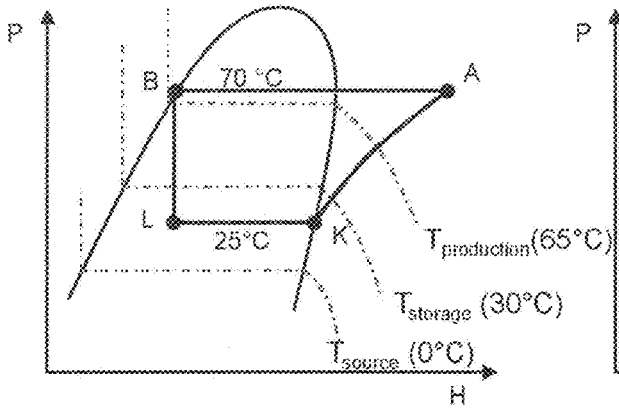

During the auxiliary heating mode (i.e., mode 3) the valves V21 and V22 are open and the valves V23, V24, V25 and V26 are closed. The first compressor 212*a* and the pump 246 are both switched on, whilst the second compressor 212*b* is switched off. As such, the low-pressure stage is deactivated. By reducing the pressure in the phase separator 222, it effectively operates as an evaporator for the high-pressure stage of the heat pump system 210*a*, 210*b*. Heat is extracted from the thermal storage device 216*a*, 216*b* and transferred to the refrigerant in the phase separator 222, where it is then circulated to the condenser 214 by the high-pressure stage. The thermodynamic cycle corresponding to the auxiliary heating mode is described by the points "K-A-B-L-K", as shown in FIG. 14.

The heat pump systems 210*a*, 210*b* is effectively transformed into a single-stage heat pump system using the thermal energy storage device 216*a*, 261*b* as a heat source to provide heat. It will be appreciated that the thermal energy storage device 216*a*, 216*b* is preferably fully charged when operating in the auxiliary heating mode. The auxiliary heating mode is particularly adapted to operating during a cold night after a long warm day when the building's occupants have been away, and so the system has been operated in the charging mode.

Figure 15:
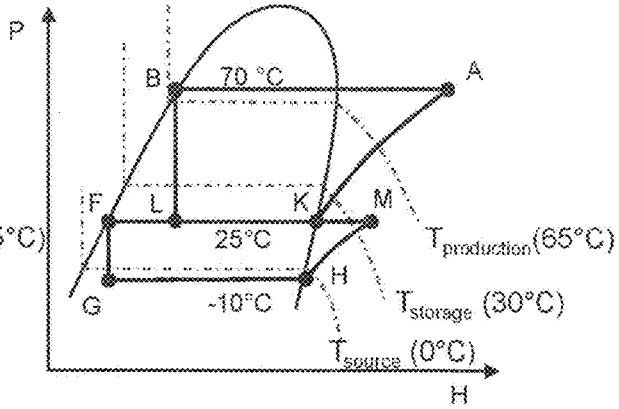

During the heat booster mode (i.e., mode 5) the valves V21-V24 are opened, and the valves V25 and V26 (in system 216*b*) are closed. Both compressors 212*a*, 212*b* are switched on, as is the pump 246. In this operation mode, the pressure in the phase separator 222 is reduced so that its temperature is slightly lower than the thermal energy storage device 216*a*, 216*b* melting temperature. Thus, thermal energy from the thermal energy storage device 216*a*, 216*b* is directed into the refrigerant in the phase separator 222. As such, the phase separator 222 acts as both a phase separator and an evaporator for the high-pressure stage, and the system is transformed, effectively, into a two-evaporator and two-compressor heat pump system. The thermodynamic cycle corresponding to the heat booster mode as shown in FIG. 15.

When operating in the heat booster mode, heat from the thermal storage device 216*a*, 216*b* and from the outdoor air (i.e., which is absorbed by the evaporator 220) are both used as heat sources, simultaneously, so as to boost the heating capacity of the heat pump system 210*a*, 210*b*. This mode is therefore particularly suited for conditions when the heat demand reaches a peak in the evening, but the outdoor temperature is low.

Figure 16:
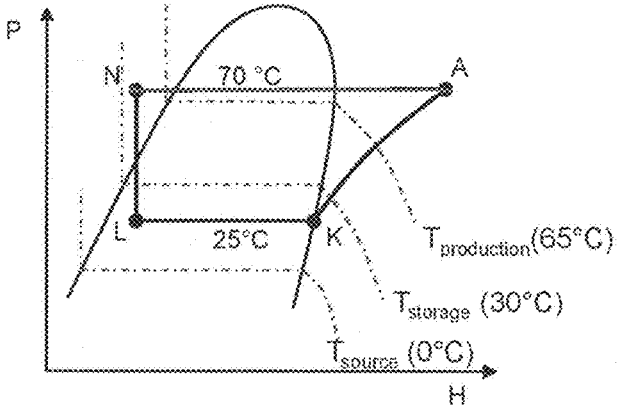

During the defrosting mode (i.e., mode 2), which is only applicable to the heat pump system 216*b*, the valves V21, V22, V25, and V26 are opened whilst valves V23 and V24 are closed. The first compressor 212*a* and the pump 246 are turned on, whilst the second compressor 212*b* is turned off. As such, the low-pressure stage is deactivated. The warm liquid refrigerant 214 is directed to pass through the evaporator 220 and thereby releases its remaining heat to melt the ice formed thereon. The refrigerant is then throttled into the phase separator 222 by the second bypass assembly 244*b*. Accordingly, the heat pump system 210*b* uses excess heat carried by the warm liquid refrigerant exiting the condenser 214 to defrost the evaporator 220. The unused heat from the condenser 214 is a source of waste heat and is not required therefore to heat the building's interior. The thermodynamic cycle corresponding to the defrosting mode is described by the points "K-A-N-L-K", as shown in FIG. 16.

During the defrosting mode, the phase separator 222 is transformed into an evaporator for the high-pressure stage. Heat stored in the thermal storage device 216*b* is extracted and used to heat up the refrigerant in the phase separator 222 to a temperature required to efficiently operate the high-pressure stage of the heat pump 210*a*. As such, the heat pump system 216*b* is transformed into a single-stage system using the thermal energy storage device 216*b* as heat source to provide heating. In this way, the evaporator 220 can be defrosted without interrupting the continuous heating supply to the condenser 214. Moreover, no extra power is needed for defrosting the evaporator 220, unlike with a conventional defrosting mode of a double-stage heat pump system. The defrosting mode is particularly suited to conditions when the outdoor ambient temperature is low, and frost starts to accumulate on the evaporator 220.

Figure 17:
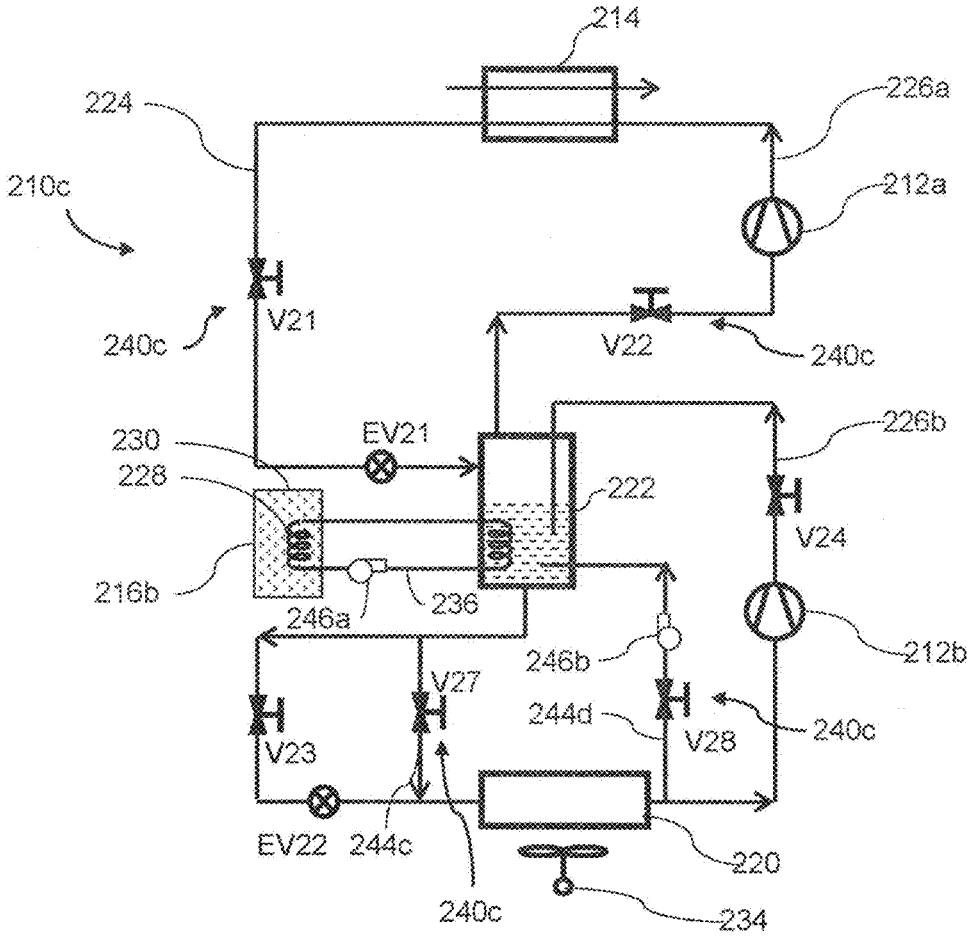
FIG. 17 is a schematic diagram of an alternative configuration of the double-stage heat pump system shown in FIG. 11.

FIG. 17 shows an alternative double-stage heat pump system 210*c* according to the present disclosure. Heat pump system 210*c* includes substantially the same components as the heat pump systems 210*a* and 210*b*, as shown in FIGS. 10 and 11, respectively. However, its switching assembly 240*c* is configured to provide an alternative means of defrosting the evaporator 220.

The switching assembly 240*c* includes a first bypass assembly 244*c* that fluidly couples to the second refrigerant circuit 226*b* at a first position immediately downstream from the phase separator 222, and at a second position immediately upstream from the evaporator 220, as shown in FIG. 17. Accordingly, the first bypass assembly 244*c* is arranged to bypass the third valve V23 and the second expansion valve EV22. A second bypass assembly 244*d* fluidly couples between the second refrigerant circuit 226*b*, at a first position immediately downstream from the evaporator 220, to the liquid containing portion of the phase separator 222. Accordingly, the second bypass assembly 244*d* is arranged to bypass the second compressor 212*b* and the fourth switching valve V24. Switching valves V27, V28 are provided to control the flow of refrigerant through the first and second bypass assemblies 244*c*, 244*d*, respectively. The heat transfer fluid circuit 236 is fitted with a first pump 246*a* to control the flow of refrigerant between the phase separator 222 and the thermal energy storage device 216*b*, and the second bypass assembly 244*d* is provided with a second pump 246*b* positioned downstream from the valve V28.

The heat pump system 216*c* operates in a similar manner to the previously described double-stage heat pump systems 216*a*, 261*b* during the operating modes 1, 4, 3 and 5. During these operating modes, the valves V27, V28 are closed and the pump 246*b* is switched off. When operating in the defrost mode, the valves V23 and V24 are closed, whilst the valves V27, V28 are opened and the second pump 246*b* is switched on. Accordingly, warm refrigerant from the phase separator 222 is pumped through the bypass assemblies 244*c*, 244*d* and directed through the evaporator 220 to melt the ice thereon. It will be appreciated that this configuration of the heat pump 216*c* requires an extra fluid pump 246*b*, which may increase the complexity and cost of the system. The defrosting time may also be longer than for heat pump system 216*b*, as shown in FIG. 11, because liquid refrigerant in the phase separator 222 is colder (e.g., 25° C.) than the hot liquid refrigerant exiting the condenser 214 (e.g., >65° C.).

The double-stage heat pump systems 210*a*, 210*b*, 210*c* provide increased flexibility of operation compared with single-stage heat pump systems and known two-stage heat pump systems. For example, they offer the flexibility to utilize off-peak electricity and/or warm outdoor air during the day, to charge the thermal storage device 216*a*, 216*b* when heat is not needed but outdoor temperatures are warm (e.g., during the day). The double-stage heat pump systems of the present disclosure also maximize heat production when heat demand peaks by using both the thermal energy storage device and the outdoor air as a source of heat.

Furthermore, the heat pump systems can store heat at an intermediate temperature (i.e., at the phase separator 222), which requires a smaller storage size than storing heat at the production temperature (i.e., at the condenser 214). For example, an intermediate pressure thermal energy storage device (according to the present disclosure) may be 20-40% smaller than an equivalent high-pressure thermal energy storage device, whilst maintaining the same performance. The size reduction is related to the COP of the high-pressure stage (e.g., 1/COP). For example, if the high-pressure stage has a COP of 3, then the size reduction in the intermediate thermal energy storage device may be 33%.

Moreover, the heat pump system 216*b*, 216*c* can provide continuous heat supply to the condenser 214 whilst defrosting the evaporator 220. The system does not need to reverse the refrigerant cycle to defrost the evaporator 220. Also, the system doesn't consume additional electricity at the low-pressure stage compressor 212*b* during defrosting.

Furthermore, no backup heaters are required for defrosting because the high-pressure stage provides continuous heat supply during the defrosting mode of operation. The switching assemblies 240*a*, 240*b*, 240*c* rely on low cost valves and bypass assemblies which are simple to install and control.

The previously described heat pump systems 210*a*, 210*b*, 210*c* each comprise two separate compressors 212*a*, 212*b* (i.e. one compressor for each of the high-pressure and low-pressure stages). A pair of alternative double-stage heat pump systems 310*a*, 310*b*, each comprising a vapour injection compressor 312 according to a further aspect of the present disclosure, will now be described with reference to FIGS. 18 and 19.

For brevity, the features in FIGS. 18 and 19, and the functioning thereof, that are the same or similar to those features already described with reference to FIGS. 10 to 17 are given similar reference numerals, but increased by 100, and will not be described in detail again.

Figure 18:
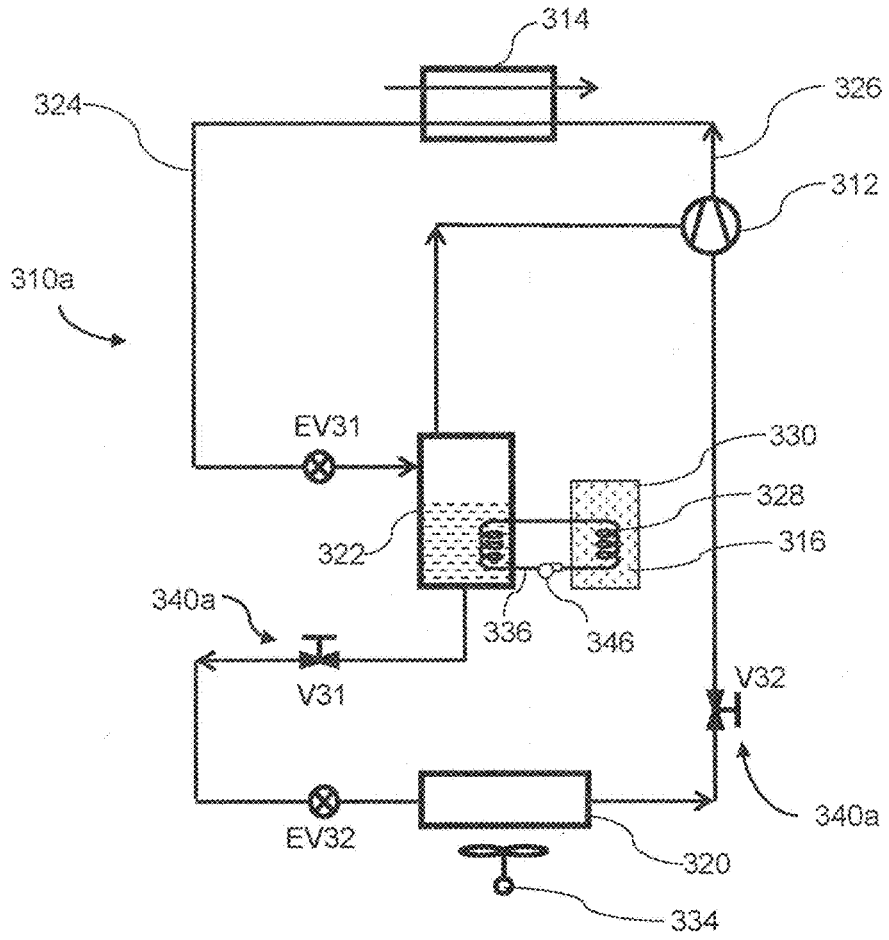
FIG. 18 is a schematic diagram of an alternative configuration of the double stage heat pump system shown in FIG. 10.

With reference to FIG. 18, the heat pump system 310*a* includes a vapour injection compressor 312 which is fluidly coupled by separate fluid conduits 324 to a condenser 314, an evaporator 320, and a phase separator 322 of the system.

The vapour injection compressor 312 has a low-pressure input for receiving refrigerant from the evaporator 320, a high-pressure output for outputting high-pressure refrigerant to the condenser 314, and an intermediate-pressure input for receiving refrigerant from the gas containing portion of the phase separator 322. When in operation, the vaporised refrigerant received from the phase separator 322 is at a higher pressure than the refrigerant leaving the evaporator 320, but at a lower pressure than the refrigerant exiting the compressor 312. The refrigerant from the phase separator 322 is 'injected' into the compressor 312 and is thereby compressed to a normal output pressure (i.e. the high-pressure outputted to the condenser 314) whilst only passing through a portion of the compressor 312.

The heat pump system 310*a* also includes a first expansion device EV31, which is fluidly coupled, in sequence, between the condenser 314 and the phase separator 322. A second expansion device EV32 is arranged in sequence between the phase separator 322 and the evaporator 320, as shown in FIG. 18. At least one of the first and second expansion devices EV31, EV32 is configured to control the downstream pressure of the refrigerant in the circuit 326, as will be understood by the skilled person. For example, the at least one expansion device is an adjustable expansion valve.

A thermal energy storage device 316 is fluidly coupled to the phase separator 322 by a separate refrigerant circuit 336 in the same manner as described above in relation to the heat pump systems 210*a*, 210*b*, 210*c*. The heat pump system 310*a* is also provided with a switching assembly 340*a*, which includes valves V31, V32. The switching assembly 340*a* is configured to switch the operation of the heat pump system 310*a* between the different operating modes, as will be explained in more detail below.

The arrangement of the phase separator 322 and the compressor 312 means that the heat pump 310*a* does not comprise two distinct refrigerant circuits, as is the case with the previously described double-stage heat pump systems 210*a*, 210*b*, 210*c*. However, a low-pressure stage of the heat pump 310*a* is defined by the refrigerant which flows from the phase separator 322, in sequence, to the second expansion device EV32, through the evaporator 320 and on to the low-pressure input of the compressor 312. Similarly, a high-pressure stage of the heat pump system 310*a* is defined by the flow of refrigerant, in sequence, from the compressor 312, through the condenser 314, through the first expansion device EV31 and on to the phase separator 322. An intermediate-pressure stage of the heat pump system is defined, for example, by the flow of refrigerant from the phase separator 322 to the intermediate-pressure input of the compressor 312.

Figure 19:
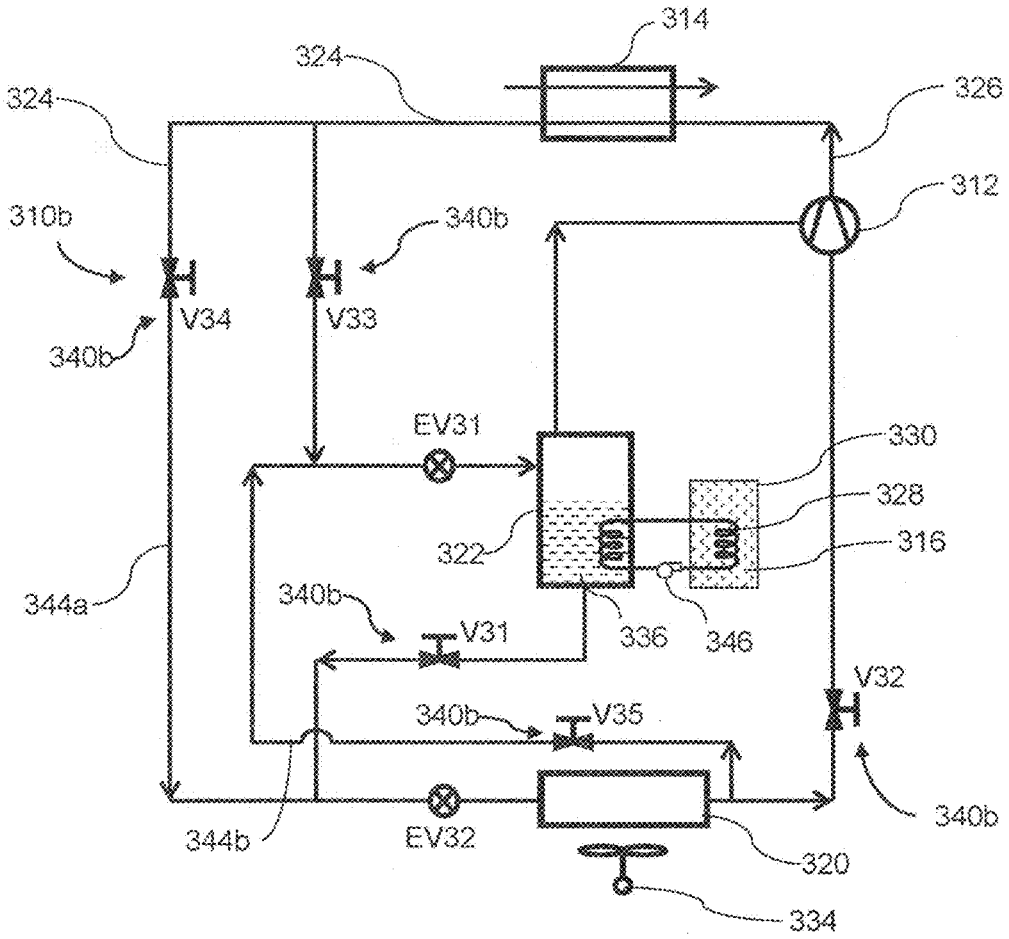
FIG. 19 is a schematic diagram of an alternative configuration of the double stage heat pump system shown in FIG. 11.

FIG. 19 shows an alternative double-stage heat pump system 310*b*, also comprising a vapour injection compressor according to the present disclosure. The heat pump system 310*b* includes substantially the same components as the heat pump system 310*a* shown in FIG. 18. However, the switching assembly 340*b* is configured differently to allow the heat pump system 310*b* to operate in a continuous heating and defrosting mode, as will be explained in more detail below.

In particular, the switching assembly 340*b* includes an additional vale V33 arranged sequentially between the condenser 314 and the first expansion valve EV31. The assembly also includes a first bypass assembly 244*a* which fluidly couples the refrigerant circuit 326, at a position immediately downstream from the condenser 314, to a position on the refrigerant circuit 326 that is immediately upstream from the second expansion valve EV32, as shown in FIG. 19. Accordingly, the first bypass assembly 344*a* is arranged to bypass the valves V31, V33, the first expansion valve EV31 and the phase separator 322. The switching assembly 240*b* also includes a second bypass assembly 344*b* that fluidly couples the refrigerant circuit 326, at a position immediately downstream from the evaporator 320, a position which is immediately upstream from the first expansion valve EV31, as shown in FIG. 19. Accordingly, the second bypass assembly 344*b* bypasses the compressor 312 and the switching valves V32, V33 and the condenser 314. Switching valves V34, V35 are provided to control the flow of refrigerant through the first and second bypass assemblies 344*a*, 344*b*, respectively.

Operation of the heat pump systems 310*a*, 310*b* will now be described with reference to Table 3, below. The heat pump system 310*a* has four different operational modes which are referred to as a normal heating mode, a heat charging mode, a heat booster mode, and an auxiliary heating mode. These four operating modes correspond, respectively, to modes 1, 4, 5 and 3 as outlined in Table 3. The heat pump system 310*b* has an additional defrosting mode which corresponds to mode 2, as outlined in Table 3.

TABLE 3

| Operational modes (valves - open/closed; compressor and pump- on/off) | | | | | | | |
|---|---|---|---|---|---|---|---|
| Mode | Pump | V31 | V32 | V33 | V34 | V35 | Phase Separator Temp. (° C.) |
| 1 | Off | Open | Open | Open | Closed | Closed | — |
| 4 | On | Open | Open | Open | Closed | Closed | Higher than TES |
| 5 | On | Open | Open | Open | Closed | Closed | Lower than TES |
| 3 | On | Closed | Closed | Open | Closed | Closed | Lower than TES |
| 2 | On | Closed | Closed | Closed | Open | Open | Lower than TES |

Table 3 outlines the different configurations of the valves V31-V36 (i.e. open/closed) and pump 346 (i.e. on/off) which are required to operate the heat pump systems 310*a*, 310*b* in the different modes. The compressor 312 is activated throughout each of the operating modes. The table also indicates the relative temperature of the refrigerant in the phase separator 322, compared to the temperature of the phase change material in the thermal energy storage device 316.

It will be appreciated that each of the numbered operating modes (i.e., 1, 4, 5, 3, and 2) described in Table 3, corresponds to the respectively numbered operating mode of the heat pump systems 210*a*, 210*b*, as outlined in Table 2, above.

Accordingly, during the normal heating mode (i.e., mode 1) the pump 346 is switched off such that the thermal energy storage device 316 is decoupled from the phase separator 322. Also, the valves V31, V32, V33 are opened to enable the heat pump systems 310*a*, 310*b* to operate as a conventional double-stage heat pump.

During the charging mode (i.e., mode 4), valves V31, V32 and V33 are open and valves V34, V35 are closed. The pump 346 is switched on, so as to couple the thermal storage system 316 to the phase separator 322. During the charging mode, the higher-pressure stage is operated to supply heat to the condenser 314 (as with the normal heating mode). However, in contrast to the normal heating mode, during the charging mode the pump 346 is switched on, thereby coupling the thermal energy storage device 316 to the phase separator 322. Also, the expansion device EV31 is adjusted to control the pressure in the phase separator 322 to ensure the temperature of the refrigerant is a few degrees higher than the melting temperature of the phase change material in the thermal energy storage device 316. This causes heat from the refrigerant to be extracted and stored in the thermal energy storage device 316.

One way in which the heat pump systems 310*a*, 310*b* differ from the heat pump systems 210*a*, 210*b*, 210*c* is that that during the charging mode (mode 4) the heat pump continues to supply heat to the condenser 314 (i.e., the 'charging mode' of heat pump systems 310*a*, 310*b* is effectively a 'continuous heating and charging mode'), whereas the heat pump system 210*a*, 210*b*, 210*c* can be operated to charge the thermal energy storage device without also supplying heat to the condenser 214 (i.e., the 'charging mode' of heat pump systems 210*a*, 210*b*, 210*c* is effectively a 'pure charging mode').

During the heat booster mode (i.e., mode 5), valves V31, V32 and V33 are open, and valves V34-V35 are closed. The pump 346 is activated such that both the thermal energy storage device 316 and the evaporator 320 are used as heat sources, simultaneously, to boost the heating capacity of the heat pump system 316*a*, 316*b*. During this operating mode, the pressure of the refrigerant in the phase separator 322 is adjusted so that the refrigerant temperature is below the melting point of the phase change material in the thermal energy storage device 316. This causes heat from the thermal energy storage device 316 to be absorbed by the refrigerant in the phase separator 322.

During the auxiliary heating mode (i.e., mode 3), valves V31, V32, V34, V35 are closed and valve V33 is opened. The pump 346 is switched on to cause transfer of heat from the thermal energy storage device 316 to the refrigerant in the phase separator 322. The low-pressure stage is deactivated, and so the phase separator 315 together with the thermal energy storage device 316 work as the evaporator for the high-pressure stage. As with mode 5, the pressure in the phase separator 322 is controlled so that the temperature of the refrigerant is lower than the melting temperature of the phase change material in the thermal energy storage device 316.

During the defrosting and continuous heating mode (i.e., mode 2), applicable to heat pump system 310*b*, the valves V31, V32 and V33 are closed, and the valves V34 and V35 are open. The warm liquid refrigerant exiting the condenser 312 is directed to pass through the evaporator 320 to release heat to melt the ice formed thereon. The cooled refrigerant is then throttled in the expansion valve EV31 before entering the phase separator 322. During this mode, the phase separator 322 together with the thermal energy storage device 316 are transformed into an evaporator for the high-pressure stage, such that the heat stored in the thermal energy storage device 316 can be extracted and lifted to the heat production temperature.

It will be appreciated that each of the operating modes 1, 4, 5, 3, and 2 are preferably applicable in substantially the same conditions as was described above in relation to the dual compressor double-stage heat pump systems 210*a*, 210*b*, 210*c*. In addition, the vapour injection compressor heat pump systems 310*a*, 310*b* have an added advantage of being more easily packaged within the building's central heating system since they require fewer components (e.g., one fewer compressor and fewer fluid conduit sections and valves etc.).

The heat pump systems 210*a*, 210*b*, 210*c*, 310*a*, 310*b*, as shown in FIGS. 10, 11 and 17 to 19, can also be applied to refrigeration applications (e.g., in a refrigerator, freezer or an air-conditioning system). It will be appreciated that for refrigeration applications, the double-stage heat pump systems are configured in reverse, with the condenser exposed to the ambient air (i.e., the heat sink) and the evaporator positioned where the load is required (e.g., the interior of a refrigerator). In this case, the required load is a negative thermal load (i.e., cold) which thereby lowers the temperature of the refrigerated area.

The double-stage heat pump systems 210*a*, 210*b*, 210*c*, 310*a*, 310*b* are particularly beneficial in situations where the heat sink temperature (i.e., the ambient outdoor air temperature) is too high and/or the desired temperature drop is too large. The operation of two of the double-stage heat pump systems 210*a*, 310*a* used in a refrigeration application is described below.

According to an exemplary operating condition of the refrigeration heat pump system, the ambient air temperature (i.e., at the condenser) is between 30° C. and 40° C. and the cooling load temperature is around −20° C. The thermal energy storage device is thermally coupled to the phase separator, which operates at an intermediate temperature of between 5° C. to 10° C. Accordingly, the total temperature drop is around 55° C., and the temperature drop provided by each of the low-pressure and high-pressure stages is around 25° C. to 30° C.

The heat pump system 210*a*, as shown in FIG. 10, can operate in four different refrigerating modes which are referred to as a normal cooling mode, an auxiliary cooling mode, a cool charging mode and a cool booster mode. The four modes correspond, respectively, to modes 6, 7, 8, and 9 as outlined in Table 4, below.

TABLE 4

| Operational modes (valves - open/closed; compressors and pump - on/off) | | | | | | | |
|---|---|---|---|---|---|---|---|
| Mode | C1 | C2 | Pump | V21 | V22 | V23 | V24 |
| 6 | On | On | Off | Open | Open | Open | Open |
| 7 | Off | On | On | Closed | Closed | Open | Open |
| 8 | On | Off | On | Open | Open | Closed | Closed |
| 9 | On | On | On | Open | Open | Open | Open |

During normal cooling mode (i.e., mode 6) the pump 246 is switched off, and each of the valves V21-V24 are open and the heat pump system 210*a* operates as a conventional two-stage refrigeration system by absorbing heat from the evaporator 220 and transferring it to the condenser 214. In this way, the heat pump system 210*a* uses the outside air (i.e. at the evaporator 220) as a heat sink.

The auxiliary cooling mode is particularly useful when the outdoor air temperature is high so that normal operation of the refrigeration system would be less efficient. When operating in the auxiliary cooling mode (i.e., mode 7), the pump 246 is switched on, the valves V21 and V22 are closed and the first compressor 212*a* is switched off. Accordingly, the high-pressure stage is deactivated, and the low-pressure stage is configured to direct heat into the thermal energy storage 216*a*. This is equivalent to extracting cooling thermal energy (i.e., a "coolth" of energy) from thermal energy storage device 216*a* and directing it into the refrigerant in the phase separator 222. In this way, the heat pump uses the thermal energy storage device 216*a* as a heat sink in which to dump heat from the evaporator 220.

During the cool charging mode (i.e., mode 8), the pump 246 is active and the valves V21, V22 are open whilst the valves V23, V24 are closed. This arrangement effectively transforms the heat pump into a single-stage system, using ambient air (i.e., at the condenser 214) as a heat sink. The heat pump is operated to extract heat from the thermal energy storage device 216*a* into the refrigerant in the phase separator 222, at an intermediate temperature of between 5° C. to 10° C. The cool charging mode is particularly advantageous when there is low cooling demand and, in particular, when the outdoor ambient temperature is also low.

The cool booster operating mode is particularly advantageous when there is high cooling demand. When operating in the cool booster mode (i.e., mode 9), each of the valves V21-V24 are open, the compressors 212*a*, 212*b* and the pump 246 are all switched on. Both the high-pressure and lower-pressure stages are activated to direct thermal energy into the thermal energy storage device 216*a* and the ambient air (i.e., at the condenser 214). By using the thermal energy storage device 216*a* as an additional heat sink, this boosts the cooling performance of the heat pump.

The vapour injection compressor double-stage heat pump system 310*a*, as shown in FIG. 18, can also be operated as a refrigeration system. In particular, the heat pump system 310*a* can operate in four different refrigerating modes which are referred to as a normal cooling mode, a cool booster mode, a combined cooling and charging mode, and a cool charging mode. The four modes correspond, respectively, to modes 10, 11, 12, and 13 as outlined in Table 5, below. The compressor 312 is activated during each of the operating modes.

TABLE 5

| Operational modes (valves - open/closed; pump - on/off) | | | | |
|---|---|---|---|---|
| Mode | Pump (246) | V31 | V32 | Flash Tank Temp. (° C.) |
| 10 | Off | Open | Open | — |
| 11 | On | Open | Open | Higher than TES |
| 12 | On | Open | Open | Lower than TES |
| 13 | On | Closed | Closed | Lower than TES |

When operating in the normal cooling mode (i.e., mode 10), the valves V31, 32 are open and the pump 346 is switched off. Thus, the heat pump system 310*a* operates as a conventional double-stage refrigeration heat pump system, i.e. by extracting heat from the evaporator 320 and directing it to the condenser 314 and wherein the thermal energy storage device 316 is deactivated.

During the cool booster mode (i.e., mode 11) the pump 346 is switched on and the valves V31, V32 are opened. The pressure in the phase separator 322 is adjusted so that the temperature of the refrigerant is higher than the melting temperature of the phase change material in the thermal energy storage device 316*a*. Accordingly, the heat pump operates as a two-stage refrigeration system which uses the thermal energy storage device 316*a* as a sub-cooler for the refrigerant and the ambient air at the condenser 214 as a heat sink.

When operating in the combined cooling and charging mode (i.e., mode 12), the valves V31 and V32 are open, and the pump 346 is activated. The pressure of the refrigerant in the phase separator 322 is adjusted so that the refrigerant temperature is below the melting point of the phase change material in the thermal energy storage device 316. This causes heat from the thermal energy storage device 316 to be absorbed by the refrigerant in the phase separator 322, which effectively stores cooling thermal energy in the thermal energy storage device 316. This operating mode is particularly applicable when the ambient temperature is relatively low since it allows the heat pump to operate as a double-stage system with the ambient air acting as a heat sink, whilst simultaneously extracting heat from the thermal energy storage device 316.

The cool charging mode (i.e., mode 13) is advantageously used when no cooling is required. During operation, valves V31 and V32 are closed thereby transforming the heat pump into a single-stage system. Once again, the pressure of the refrigerant in the phase separator 322 is adjusted so that the refrigerant temperature is below the melting point of the phase change material. Thus, heat is extracted from the thermal energy storage device 316 at a temperature of around 5° C. to 10° C. for later use (e.g., during mode 11), and directed towards the condenser 314 operating as a heat sink.

The heat pump systems 210*a*, 210*b*, 210*c*, 310*a*, 310*b* as shown in FIGS. 10 and 18, can also be applied to combined heating and cooling operations when there is a mismatch between heating and cooling demand. In this situation, thermal energy can be stored at an intermediate temperature within the thermal energy storage device, which enables the system to match the production and demand as necessary.

Figure 20:
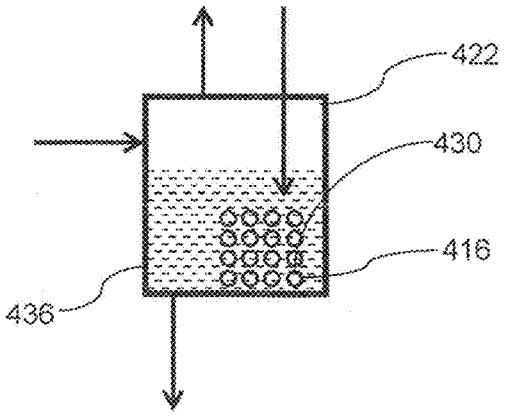
FIG. 20 is a schematic diagram of an alternative thermal energy storage assembly of the heat pump systems shown in FIGS. 10, 11 and 17 to 19.

In an alternative exemplary arrangement of any of the double-stage heat pump systems, the thermal energy storage device may be arranged within the phase separator 422, as shown in FIG. 20. The thermal energy storage device 416 comprises a plurality of individual thermal energy storage elements (e.g., spheres or balls). Each of the energy storage elements comprises a volume of phase change material encapsulated within a case 430. In contrast to the thermal energy storage devices 216, 316, as described above, the internal thermal energy storage device 416 does not include a pump or heat transfer fluid circuit. Instead, each case 430 of the plurality of energy storage elements is configured to allow thermal energy to flow (e.g., by thermal conduction), passively, between the phase change material contained therein and the refrigerant contained within the phase separator 422. For example, the cases 430 may be formed of a metallic material. By providing a plurality of smaller energy storage elements, this increase the surface area of the phase change material which is in contact with the refrigerant in the phase separator 422.

It will be appreciated that the 'internally' configured thermal energy storage device 416 may have a smaller capacity than an 'externally' mounted thermal energy storage device (such as device 216 shown in FIG. 10). However, the internal thermal energy storage device 416 is easier to house within a heat pump system since it can be packaged within the footprint of the phase separator 422. Furthermore, the passive internal thermal energy storage device 416 has no moving parts which makes it easier and cheaper to operate and service.

Case Study 1—Double-Stage Heating System

In order to demonstrate the performance difference between a normal heating mode vs. a combination of the heating charging and auxiliary heating modes, a representative simulation of heat pump systems has been conducted based on data obtained from a commercially available simulation software.

The operational conditions are determined to be:

Outdoor air temperature varies between 0° C. and 10° C. throughout the day.

Output temperature of the condenser: 65° C.

Isentropic efficiency of the compressor: 70

Melting temperature of the phase change material: 30° C.

10° C. approach temperature of the evaporator.

3° C. approach temperature of the condenser.

3° C. approach temperature of the thermal energy storage device.

The refrigerant: R134a.

A double-stage heat pump system is used as a benchmark for the following analysis. The system undergoes the following steps when operating in the normal heating mode (i.e., mode 1):

High temperature refrigerant vapour at 80.3° C. enters the condenser, where it releases heat to the water from the central heating system and it condenses and is cooled down to 70° C. Water from the central heating system returns at 40° C., and is heated up to 65° C. within the condenser. The hot liquid refrigerant at 70° C. and 21.28 bar is then throttled to 33° C. and 8.39 bar through the first expansion device, and then enters the phase separator. The vapour is removed by the high-pressure stage compressor, while the liquid refrigerant is further throttled down to −20° C. and 1.33 bar through the second expansion device. The mixture then enters the evaporator to absorb heat from ambient air at 0° C., and cools it down to −10° C. The mixture then fully evaporates into low pressure saturated vapour at −20° C. The low-pressure stage compressor extracts the low-pressure vapour and compresses it to the intermediate pressure of the phase separator. After the compression, the superheated vapour then bubbles through the liquid refrigerant in the phase separator to be cooled down to a saturated vapour. Together with the vapour produced through the first throttling process, it is then extracted and compressed by the high-pressure stage compressor and directed to the condenser pressure, before starting a new cycle.

The parameters and results of the normal heating mode (i.e., mode 1) simulation are summarised as follows:

Outdoor air temperature: 0° C.

Evaporating pressure: 1.33 bar

Condensing pressure: 21.28 bar

Low-pressure stage compressor power consumption: 0.905 kW,

Low-pressure stage compressor mass flow rate: 0.017 kg/s

High-pressure stage compressor power consumption: 0.781 kW.

High-pressure stage compressor mass flow rate: 0.029 kg/s

Heat power output from the condenser at 65° C.: 4 kW (=14400 kJ/h).

Heat extracted from the outdoor air at 0° C.: 2.314 kW (=8330.4 kJ/h).

COP of the system during the normal heating mode is 4/(0.905+0.781)=2.37.

The results of the heat charging mode (i.e., mode 4) simulation are summarised as follows:

The charging mode is used when there is low heat demand and the outdoor air temperature is high (e.g., 10° C.) during the day. During this mode, the high-pressure stage is deactivated, and the low-pressure stage is isolated to charge the thermal energy storage device. The evaporator extracts 2.51 kW heat from the ambient air and cools it down from 10 to 0° C. The phase separator temperature is held at 33° C. and the temperature of phase change material in the thermal energy storage device is 30° C. The phase separator and the thermal energy storage device effectively work as a condenser for the low-pressure stage. Heat is stored within the thermal energy storage device at a rate of 3.25 kW. The low-pressure stage compressor consumes 0.73 kW, and thus the heat pump $COP_L$ is 4.45.

The results of the auxiliary heating mode (i.e., mode 3) simulation are summarised as follows:

During the auxiliary heating mode, the high-pressure stage is operated in isolation, such that heat is removed from the thermal energy storage device via the phase separator and uplifted to provide heating. The heat stored in the thermal energy storage device is determined to be 30° C. with 3° C. approach temperature, and so the temperature of the phase separator is maintained at 27° C. The phase separator and the thermal energy storage device effectively work as the evaporator for the high-pressure stage, so as to produce heat at a rate of 4 kW at the condenser. The high-pressure stage compressor consumes 0.92 kW, and the thermal energy storage device releases 3.08 kW at 30° C. Accordingly, the calculated heat pump $COP_H$ for the isolated high-pressure stage is 4.35.

By operating the heat pump system 216*a* using a combination of the heat charging and auxiliary heating modes, it enables the system to deliver heat more efficiently in conditions where the ambient temperature varies throughout the day. The two operating modes are made possible because each of the high-pressure and low-pressure stages of the heat pump system can be operated independently and in isolation from the other. To demonstrate this effect, the overall COP of the heat pump system can be calculated based on the COP values corresponding to the heat charging and auxiliary heating modes, as determined above.

$$COP_{ovall} = \frac{Q_{H,overall}}{W_{overall}} = \frac{\frac{(COP_L)(COP_H)}{COP_H - 1}}{\frac{COP_L}{COP_H - 1} + 1} = \frac{(COP_L)(COP_H)}{COP_L + COP_H - 1} = \frac{(4.45)(4.35)}{4.45 + 4.35 - 1} = 2.48 \quad (6)$$

The calculated overall COP is 2.48, which is 5% higher than the benchmark case that directly extracts heat from air at 0° C. and produces heat at 65° C. in the evening.

Case Study 2—Two-Stale Refrigeration System.

In order to demonstrate the performance difference between a normal cooling mode vs. a combination of the cooling charging and auxiliary cooling modes, a representative simulation of heat pump systems has been conducted based on data obtained from a commercially available simulation software.

The operational conditions are determined to be:

Outdoor air temperature varies between 20° C. to 35° C. throughout the day.

Input temperature of the evaporator: −25° C.

Isentropic efficiency of the compressor: 70%

Melting temperature of the phase change material: 5° C.

10° C. approach temperature of the evaporator.

10° C. approach temperature of the condenser.

3° C. approach temperature of the thermal energy storage device.

The refrigerant: R134a.

A double-stage heat pump system 210*a* is used as a benchmark for the following analysis. The system undergoes the following steps when operating in the normal cooling mode (i.e., mode 6):

High temperature refrigerant vapour at 67.2° C. enters the condenser, where it rejects heat to ambient air at 35° C. The hot liquid refrigerant at 55° C. and 14.96 bar is then throttled to 8° C. and 3.87 bar through the first expansion device, and then enters the phase separator. The vapour is removed by the high-pressure stage compressor, while the liquid refrigerant is further throttled down to −25° C. and 1.06 bar through the second expansion device. The mixture then enters the evaporator to absorb heat from the cooling load. The mixture finally fully evaporates into low pressure saturated vapour at −25° C. The low-pressure stage compressor extracts the low-pressure vapour and compresses it to the intermediate pressure, which is also the pressure of the phase separator. After the compression, the superheated vapour then bubbles through the liquid refrigerant in the phase separator to be cooled down to a saturated vapour. Together with the vapour produced through the first throttling process, it is then extracted and compressed by the high-pressure stage compressor to the condenser pressure.

The parameters and results of the normal cooling mode (i.e., mode 6) simulation are summarised as follows:

Outdoor air temperature: 35° C.

Evaporating pressure: 1.06 bar

Condensing pressure: 14.96 bar

Low-pressure stage compressor power consumption: 0.821 kW,

Low-pressure stage compressor mass flow rate: 0.023 g/s

High-pressure stage compressor power consumption: 1.479 kW.

High-pressure stage compressor mass flow rate: 0.039 g/s

Heat output from the condenser at 55° C.: 6.34 kW (=22840 kJ/h).

Cold extracted from the cooling load at the evaporator at −25° C.: 4.04 kW (=14560 kJ/h).

COP of the system during the normal heating mode is 4.04/(0.821+1.479)=1.76.

According to an exemplary method of operating the refrigeration system, the isolated high-pressure stage may be used to first extract heat from the thermal energy storage device during the evening when the ambient temperature is low, so the COP will be higher, and then the depleted phase change material absorbs thermal energy during the following day when the ambient outdoor temperature is higher, thereby further increasing the COP of the system. In order to evaluate the potential energy saving of this flexible operational strategy, a simulation case is considered in which the heat pump is operated in the cooling charging mode (i.e., mode 8) in the evening and then in auxiliary cooling mode (i.e., mode 7) during the following day.

The results of the cool charging mode (i.e., mode 8) simulation are summarised as follows: During the cool charging mode, the cooling demand is low and the outdoor air temperature is also low (e.g., 20° C.), and so the high-pressure stage is isolated to extract heat from the thermal energy storage device. The thermal energy storage device is 5° C. with a 3° C. temperature difference for charging and discharging. Accordingly, the phase separator temperature is held at 2° C. The phase separator and the thermal energy storage device work as the evaporator for the high-pressure stage. The heat pump system delivers refrigeration at a rate of 4.627 kW, which is stored in the thermal energy storage device, and the high-pressure stage compressor consumes 1.128 kW. The calculated cooling $COP_H$ is 4.1 for the isolated high-pressure stage.

The results of the auxiliary cooling mode (i.e., mode 7) simulation are summarised as follows: During the auxiliary cooling mode, the low side of the system is isolated, and heat is dumped into the thermal energy storage device via the phase separator. The thermal energy storage device is used as the heat sink instead of the ambient air, which is at a higher temperature during the day. For this simulation, the cooling thermal energy stored in the thermal energy storage device is assumed to be 5° C. with 3° C. approach temperature for heat transfer, and the phase separator is maintained at 8° C. The phase separator and the thermal energy storage device work as the condenser for the low-pressure stage which produces refrigeration at a rate of 4 kW. The low-pressure stage compressor consumes 0.87 kW. Accordingly, the calculated cooling COPS for the low-pressure stage is 4.6.

Based on the calculated COPs of the two isolated stages of cooling systems, the energy flows of this decoupled and staggered operation strategy. The overall COP of this operation can then be calculated as:

$$COP_{ovall} = \frac{Q_{cooling,overall}}{W_{overall}} = \frac{COP_L}{\frac{COP_{L+1}}{COP_H} + 1} = \frac{4.6}{\frac{4.6+1}{4.1} + 1} = 1.94 \quad (7)$$

The calculated overall COP is 1.94, which is 10.5% higher than the benchmark case that directly extracts heat at −25° C. and reject heat to air at 35° C. during the day.

Several the exemplary heat pump systems, as described herein with reference to FIGS. 1 to 20, share one or more features that have similar structures and/or functionalities. Furthermore, it will be appreciated that each of the exemplary heat pump systems are not limited to the particular arrangements in which they are described and illustrated. For example, each of the exemplary heat pump systems may incorporate additional features or may be incorporated within other systems (e.g. building heating systems), without departing from the scope of the present disclosure. Moreover, it will be appreciated that any one of the features of the exemplary heat pump systems may be combined with any of the features of the other of the exemplary heat pump systems without departing from the scope of the present disclosure.

The invention claimed is:

1. A method of operating a heat pump system for controlling an internal temperature of a building, the system comprising:

a compressor, a first heat exchanger, an expansion device and a second heat exchanger which are fluidly coupled together by a flowing refrigerant to define a refrigerant circuit, and a thermal energy storage means which is thermally coupled to the refrigerant circuit to exchange thermal energy with the flowing refrigerant;

wherein the heat pump system is configured to operate in a normal heating mode and in a defrosting mode, wherein:

in the normal heating mode, thermal energy is transferred from the second heat exchanger into the flowing refrigerant and transferred from the flowing refrigerant by the first heat exchanger to heat the building, and in the defrosting mode, thermal energy is transferred from the thermal energy storage means into the flowing refrigerant and transferred from the flowing refrigerant by the first heat exchanger to heat the building and by the second heat exchanger to defrost the second heat exchanger;

wherein the method comprises, when operating the heat pump system in the defrosting mode, directing the flowing refrigerant exiting the first heat exchanger to flow through the second heat exchanger to cause residual heat in the flowing refrigerant to defrost the second heat exchanger.

2. A method of operating a heat pump system for controlling an internal temperature of a refrigeration unit, the system comprising:

a compressor, a condenser, an expansion device and an evaporator which are fluidly coupled together by a flow of refrigerant to define a refrigerant circuit, and a thermal energy storage means which is thermally coupled to the refrigerant circuit to exchange thermal energy with the refrigerant, wherein the refrigerant circuit comprises a high-pressure stage and a low-pressure stage which are fluidly coupled together by a phase separator, wherein the high-pressure stage comprises the condenser and the low-pressure stage comprises the evaporator; wherein the heat pump system is configured to operate in a cool charging mode and in an auxiliary cooling mode wherein:

in the cool charging mode, thermal energy is transferred from the thermal energy storage means into the refrigerant and transferred from the refrigerant by the condenser to heat external ambient air, and in the auxiliary cooling mode thermal energy is transferred from the evaporator into the refrigerant to cool an internal area of the refrigeration unit and transferred from the refrigerant to the thermal energy storage means;

wherein the method comprises, when operating the heat pump system in the cool charging mode, isolating the high-pressure stage and, when operating the heat pump system in the auxiliary cooling mode, isolating the low-pressure stage.

3. The method according to claim 1, wherein the heat pump system comprises a switching assembly which is configured to switch between the normal heating and defrosting modes.

4. The method according to claim 3, wherein the switching assembly is configured, when operating the heat pump system in the defrosting mode, to direct the flowing refrigerant exiting the first heat exchanger through, sequentially, the second heat exchanger, the expansion device and the compressor.

5. The method according to claim 3, wherein the thermal energy storage means is coupled to the refrigerant circuit between the expansion device and the compressor.

6. The method according to claim 4, wherein the switching assembly comprises a four-way valve which, when operating the heat pump system in the defrosting mode, is configured to directly couple the first heat exchanger to the second heat exchanger.

7. The method according to claim 3, wherein the switching assembly is arranged, when operating the heat pump system in the defrosting mode, to bypass the expansion device and direct the flowing refrigerant exiting the first heat exchanger through, sequentially, a second expansion device, the thermal energy storage means, the second heat exchanger and the compressor.

8. The method according to claim 7, wherein the switching assembly comprises a first bypass assembly which is configured, when the heat pump system is operating in the defrosting mode, to isolate the expansion device from the refrigerant circuit.

9. The method according to claim 7, wherein the thermal energy storage means is coupled to the refrigerant circuit between the second expansion device and the second heat exchanger.

10. The method according to claim 9, wherein the switching assembly comprises:

a first bypass assembly which is configured, when the heat pump system is operating in the defrosting mode, to isolate the expansion device from the refrigerant circuit; and a second bypass assembly which, when the heat pump system is operating in the defrosting mode, is configured to fluidly couple the second expansion device to the refrigerant circuit between the first heat exchanger and the thermal energy storage means.

11. The method according to claim 7, wherein the heat pump system is configured to be operated in a heat charging mode in which thermal energy is transferred from the flowing refrigerant to the thermal energy storage means, wherein the switching assembly, when operating the heat pump system in the heat charging mode, is configured to direct the flowing refrigerant exiting the compressor to bypass the second expansion device and the first heat exchanger.

12. The method according to claim 3, wherein the heat pump system is configured to be operated in an auxiliary heating mode in which thermal energy is transferred from the thermal energy storage means into the flowing refrigerant, wherein the switching assembly, when operating the heat pump system in the auxiliary heating mode is configured to bypass the expansion device and the second heat exchanger.

13. The method according to claim 1, wherein the thermal energy storage means comprises a phase change material.

14. The method according to claim 13, wherein the phase change material is arranged in direct thermal contact with a conduit of the refrigerant circuit.

15. The method according to claim 13, wherein the phase change material is thermally coupled to a conduit of the refrigerant circuit by a circuit comprising a heat transfer fluid.

16. The method according to claim 1, wherein the refrigerant circuit comprises a high-pressure stage and a low-pressure stage which are fluidly coupled together by a phase separator, wherein the high-pressure stage comprises the first heat exchanger and the low-pressure stage comprises the second heat exchanger.

17. The method according to claim 16, wherein the thermal energy storage means is thermally coupled to the phase separator.

18. The method according to claim 16, wherein the compressor defines a compressor assembly comprising a first compressor fluidly coupled to the high-pressure stage, and a second compressor fluidly coupled to the lower-pressure stage.

19. The method according to claim 16, wherein the compressor comprises a vapour injection compressor which is fluidly coupled to both the high-pressure and low-pressure stages of the refrigerant circuit.

20. The method according to claim 16, wherein the expansion device defines an expansion device assembly comprising a first expansion device fluidly coupled to the high-pressure stage, and a second expansion device fluidly coupled to the lower-pressure stage.

21. The method according to claim 3, wherein the refrigerant circuit comprises a high-pressure stage and a low-pressure stage which are fluidly coupled together by a phase separator, wherein the high-pressure stage comprises the first heat exchanger and the low-pressure stage comprises the second heat exchanger, wherein the expansion device defines an expansion device assembly comprising a first expansion device fluidly coupled to the high-pressure stage, and a second expansion device fluidly coupled to the lower-pressure stage, and wherein the switching assembly is arranged, when operating the heat pump system in the defrosting mode, to bypass the first expansion device and direct the flowing refrigerant exiting the first heat exchanger through, sequentially, the second expansion device, the second heat exchanger and the phase separator.

22. The method according to claim 1, wherein the second heat exchanger is thermally coupled to a heat source, and wherein the first heat exchanger is thermally coupled to a central heating system of the building.

* * * * *